US011187136B2

(12) United States Patent
Scanlon

(10) Patent No.: US 11,187,136 B2
(45) Date of Patent: Nov. 30, 2021

(54) VORTICITY BASED NOISE ABATEMENT

(71) Applicant: U.S. Army Research Laboratory ATTN: RDRL-LOC-I, Adelphi, MD (US)

(72) Inventor: Michael V. Scanlon, Laurel, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 574 days.

(21) Appl. No.: 15/846,251

(22) Filed: Dec. 19, 2017

(65) Prior Publication Data

US 2019/0186332 A1 Jun. 20, 2019

(51) Int. Cl.

| | |
|---|---|
| ***F01N 1/08*** | (2006.01) |
| ***F01N 1/12*** | (2006.01) |
| ***F01N 13/18*** | (2010.01) |
| ***F01N 1/02*** | (2006.01) |

(52) U.S. Cl.

CPC ..... *F01N 13/1888* (2013.01); *F01N 1/02* (2013.01); *F01N 1/085* (2013.01); *F01N 1/086* (2013.01); *F01N 13/1838* (2013.01); *F01N 13/1877* (2013.01); *F01N 2470/02* (2013.01)

(58) Field of Classification Search

CPC . F01N 1/08; F01N 1/085; F01N 1/086; F01N 1/12; F01N 1/087; F01N 1/088; F01N 1/02; F01N 13/1888; F01N 13/1838; F01N 2470/02

See application file for complete search history.

(56) References Cited

U.S. PATENT DOCUMENTS

| | | | | | |
|---|---|---|---|---|---|
| 1,772,589 | A | * | 8/1930 | Beamer | F01N 1/089 181/265 |
| 2,057,304 | A | * | 10/1936 | Saint-Jacques | F01N 1/088 181/274 |
| 2,205,899 | A | * | 6/1940 | Chipley | F01N 1/24 181/269 |
| 2,239,549 | A | * | 4/1941 | Chipley | F01N 1/089 181/269 |
| 2,468,384 | A | * | 4/1949 | Tyskewicz | F01N 1/087 181/240 |
| 2,511,713 | A | * | 6/1950 | Hoyle | F01N 3/06 96/319 |
| 2,517,623 | A | * | 8/1950 | Baird | F01N 1/08 181/268 |

(Continued)

FOREIGN PATENT DOCUMENTS

| | | | | | |
|---|---|---|---|---|---|
| DE | 802205 | C | * | 2/1951 | F01N 1/08 |
| FR | 688224 | A | * | 8/1930 | F01N 1/089 |

(Continued)

*Primary Examiner* — Edgardo San Martin
(74) *Attorney, Agent, or Firm* — Alan I. Kalb

(57) ABSTRACT

A noise abatement system including at least one fluid circulation chamber to receive at least one flow of fluid; at least one vorticity-inducing component adjacent to the at least one fluid circulation chamber, the at least one vorticity-inducing component to redirect the at least one flow of fluid tangentially to an inside perimeter wall of the at least one fluid circulation chamber to create fluctuations in a flow and pressure of the fluid causing increased and variable vorticity within the at least one fluid circulation chamber; and at least one vorticity-interaction region in communication with the at least one vorticity-inducing component to attenuate acoustics caused by the at least one flow of fluid.

4 Claims, 27 Drawing Sheets

(56) References Cited

U.S. PATENT DOCUMENTS 2,646,854 A * 7/1953 Walker ..... F01N 13/1894 181/280
3,374,857 A * 3/1968 Hutchins ..... F01N 3/037 181/244
3,750,841 A * 8/1973 Brown ..... F01N 1/087 181/274
3,884,323 A * 5/1975 Kunz, Jr. ..... B04C 9/00 181/247
3,907,528 A * 9/1975 Halter ..... B04C 5/04 96/385
3,964,570 A * 6/1976 Morrow ..... F01N 1/10 181/268
4,162,904 A * 7/1979 Clay ..... F01N 3/037 96/381
4,317,502 A * 3/1982 Harris ..... F01N 1/12 181/280
5,746,630 A * 5/1998 Ford ..... B63H 21/32 181/260
5,844,178 A * 12/1998 Lothringen ..... F01N 1/12 181/269
5,962,822 A * 10/1999 May ..... F01N 1/083 181/258
6,892,853 B2 * 5/2005 Cai ..... F01N 1/087 181/249
2011/0005856 A1 * 1/2011 Larson ..... F01N 1/04 181/211
2019/0257330 A1 * 8/2019 Hill ..... F01N 1/087

FOREIGN PATENT DOCUMENTS

FR 1217203 A * 5/1960 ..... F01N 1/087
GB 395929 A * 7/1933 ..... F01N 1/14
GB 2110298 A * 6/1983 ..... F01N 1/003
KR 100996511 B1 * 11/2010 ..... F01N 13/0097

* cited by examiner

VORTICITY BASED NOISE ABATEMENT

GOVERNMENT INTEREST

The embodiments described herein may be manufactured, used, and/or licensed by or for the United States Government without the payment of royalties thereon.

BACKGROUND

Technical Field

The embodiments herein generally relate to noise abatement systems and more particularly to a noise abatement for an engine's exhaust.

Description of the Related Art

Conventional vehicle and equipment mufflers use the expansion and contraction of exhaust gasses within varying volumes to reduce and elongate the acoustic pressure pulses before exiting into atmosphere. They rely on tubes of differing lengths or cross-sections connecting chambers sealed to create different pressure regions in each chamber and rely on expansion and contraction losses to dissipate energy to reduce the sound level that is emitted. Dissipative mufflers rely on the presence of sound-absorbing materials, lined ducts, and densely spaced holes expanding into larger volumes. Reactive mufflers have variable impedances by reflecting some acoustic energy back towards the noise source. Volume-resonant mufflers act as Helmholtz resonators to remove specific frequencies; they usually do not have flow going through them and pull energy from the supply pipe. Pipe resonator mufflers connect expansion chambers, with tubes protruding into the chambers at differing lengths, which also control the frequency-dependent attenuation ranges or resonance frequencies of the particular system. Accordingly, traditional muffler systems typically use simplistic expansion volumes of different sizes that are connected with pipes of different cross-sectional areas and lengths. These systems rely on expansion losses and pathway confusion.

SUMMARY

In view of the foregoing, an embodiment herein provides a noise abatement system comprising at least one fluid circulation chamber to receive at least one flow of fluid; at least one vorticity-inducing component adjacent to the at least one fluid circulation chamber, the at least one vorticity-inducing component to redirect the at least one flow of fluid tangentially to an inside perimeter wall of the at least one fluid circulation chamber to create fluctuations in a flow and pressure of the fluid causing increased and variable vorticity within the at least one fluid circulation chamber; and at least one vorticity-interaction region in communication with the at least one vorticity-inducing component to attenuate acoustics caused by the at least one flow of fluid. The at least one fluid circulation chamber may comprise a cylindrical chamber.

The at least one vorticity-inducing component may be configured to create a vortex diode comprising hysteretic flow pressure resistance of the fluid. The at least one vorticity-inducing component may comprise at least one radial expansion component to radially expand the at least one flow of fluid, wherein the at least one radial expansion component may be configured to receive the at least one flow of fluid in an axial direction relative to the fluid circulation chamber and disperse the at least one flow of fluid in a tangential direction relative to the circulation chamber. The at least one fluid circulation chamber that disperses the at least one flow of fluid in the tangential direction may create a vortex circulation of the at least one flow of fluid. The at least one radial expansion component may comprise a plurality of radial expansion components arranged in a nested configuration. The system may comprise at least one input pipe operatively connected to the at least one fluid circulation chamber. The at least one input pipe may be positioned tangential to the at least one fluid circulation chamber. The at least one input pipe may comprise a multi-shaped configuration that transitions from a substantially curved configuration to a substantially quadrilateral configuration. The at least one fluid circulation chamber may comprise a muffler containing the at least one fluid circulation chamber, wherein each fluid circulation chamber is configured to provide a different vortex flow of the at least one fluid from other fluid circulation chambers.

Another embodiment provides a muffler comprising a first cylindrical body comprising at least one section; an input plenum connected to the at least one section; a pair of sidewalls defining a length of the at least one section; a pipe extending from the at least one section and through the pair of sidewalls; an opening in a first sidewall of the pair of sidewalls; a second cylindrical body aligned with the first cylindrical body; a truncated cone structure surrounding a portion of the pipe; at least a first hole disposed in the pipe between a second sidewall of the pair of sidewalls and the truncated cone structure; and an inner cylindrical sleeve adjacent to the truncated cone structure and aligned along an inner wall of the second cylindrical body and surrounding a portion of the pipe, wherein the pipe extends out of the second cylindrical body. The truncated cone structure may comprise a plurality of channels to introduce at least one of a circulation and vorticity of fluid traversing the second cylindrical body. The muffler may comprise a plurality of truncated cone structures nested in a stack arrangement. The muffler may comprise at least one helix component comprising a plurality of blades defining a spiral configuration. The input plenum may be positioned tangential to the first cylindrical body. The muffler may comprise at least a second hole disposed in the pipe after the truncated cone structure. The muffler may comprise multiple sub-compartments aligned with one another; and a substantially central port extending through the multiple sub-compartments and connected to the pipe.

Another embodiment provides a method of abating noise, the method comprising receiving a flow of fluid in a first direction in a muffler; redirecting the flow of fluid in a second direction tangential to the first direction; creating fluctuations in a flow and pressure of the fluid causing increased and variable vorticity within the muffler; and attenuating acoustic emissions associated with the flow of fluid being output from the muffler due to the fluctuations of the flow and pressure of the fluid and the increased and variable vorticity within the muffler. The method may comprise radially expanding the flow of fluid within the muffler. The method may comprise creating a vortex circulation of the flow of fluid within the muffler. The method may comprise modifying any of the vorticity and the acoustic emissions in the muffler.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
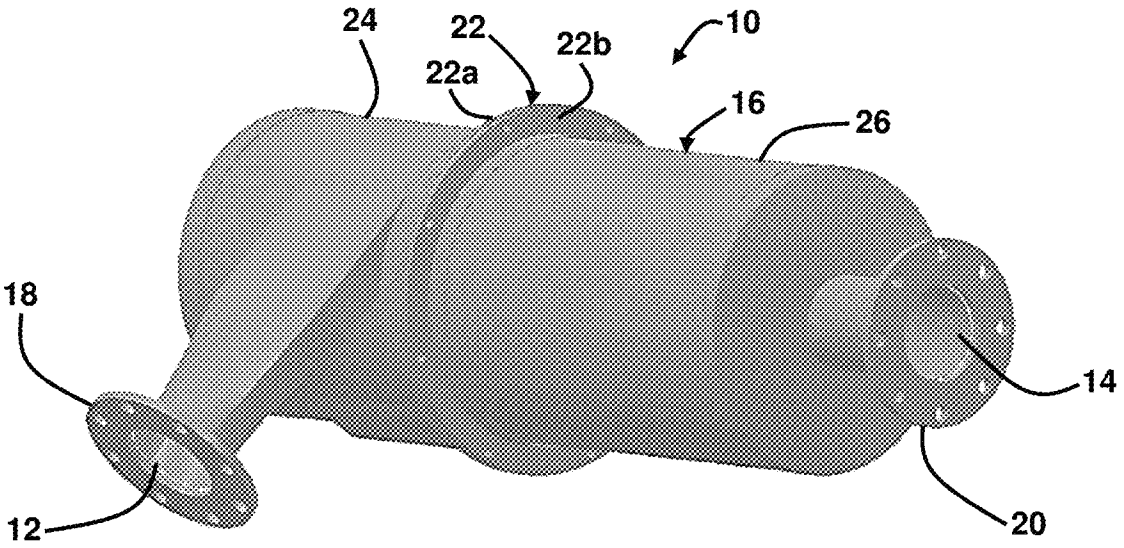
FIG. 1 illustrates a two-stage muffler, according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein provide a noise abatement system, method, and device that uses vortex diodes and vorticity-based features to attenuate the exhaust noises emanating from a large engine's exhaust. This vorticity muffler takes advantage of advanced fluid dynamic principles such as vorticity, circulation, and vortex diodes. One embodiment creates vortex circulation by redirecting flows tangentially to the inside perimeter of cylindrical volumes so that instantaneous fluctuations in flow and pressure will cause increased and variable vorticity within the cylindrical cavities. The traditional systems do not create circulation, vorticity, or exploit the fluid-dynamic principles of the vortex diode.

In a typical vortex diode configuration, centripetal acceleration forces the circulating fluids outward and away from the lower-resistance center exit port. Constrained circulation within the cylinder walls increases the path lengths and associated time-scales of the pulsating fluid. Radial pressure gradients keep highest pressures circulating at the outermost walls. Higher-pressure jets of exhaust flow may reinforce, entrain and leverage lower-pressure flows. Tangentially directed nozzles force circulation along inner perimeter walls of the muffler's preferably cylindrical shell. Elliptical cross sections may also function in a similar fashion, with variable velocities due to changing arcs or radii of curvatures. Higher pressure and lower velocity gasses circulate at the perimeter due to centripetal acceleration. Decreasing pressure forces gasses to circulate closer to the center ports of each section with higher angular velocity. The lower pressure gasses, with highest pressure pulsations still radially outward at the perimeter, pass through central ports or pipes with residual circulation to help initiate or sustain vortex flow within the next section. These gasses are then forced into additional vortex chambers of differing volumes, lengths and radii to provide broadband reduction of pressure pulsations from the engine or generator. These vorticity chambers will fluid-dynamically adapt to the changes in RPM and stroke volume of the engines under loaded or unloaded conditions; as engine power increases, so will the vortex velocities and pressure gradients. The ultimate goal is to improve noise suppression without affecting performance of the vehicle. The embodiments herein also reduce back-pressure to increase MPG, horsepower and torque.

The embodiments herein may apply to cars, trucks, ATVs, UAVs and other air or ground vehicles, recreational equipment, lawn mowers, weed and grass trimmers, generators, chainsaws, blowers, heavy machinery, pumps and any noisy source. The embodiments herein may work on any fluid; in gaseous or liquid state. For example, there may be instances where pressure perturbations from water pumps need to be quieted or turbulence needs to be removed. Referring now to the drawings, and more particularly to FIGS. 1 through 29, there are shown exemplary embodiments.

The fluid-dynamic principles and features of the embodiments herein may artificially increase path lengths, create pressure and velocity gradients, and add hysteresis effects to significantly modify the pulse structure. A vortex diode is a fluidic device which has a preferential flow direction and a higher resistance in the reverse direction through the creation of vorticity though tangentially injected flows within a cylindrical cavity. A forced vortex circulating within the confining walls of a cylindrical void will continue to spin if reinforced with additional flow tangentially injected along the outermost perimeter.

The vortex diode acts as a variable flow restrictor through the strength of the constrained vortex. Output power may be modulated by the strength of the tangentially directed control jet. The vortex strength is the product of the tangential velocity and the circumference, and the velocity varies with the radius, and is the product of the angular velocity and the radius. One or more jets may be incorporated to control the vorticity as well as act as a summing junction of the individual flows. With no control jets oriented to create a vortex, the pressure throughout the chamber will be equal to the supply pressure, with no pressure gradients. The stronger the vortex, the steeper the pressure gradient is, which reduces the output flow through the center port. All flow entering the vortex-chamber must also leave, therefore maintaining a conservation of momentum. Constant angular momentum creates the relationship that as the radius of circulation decreases, the tangential velocity increases. As the pressure increases, the velocity decreases, and vice versa. The pressure in the vortex decreases with decreasing radius. In vortex motion, fluid streamlines form concentric circles and are tangential to the instantaneous velocity vectors. Therefore, the radial component of velocity is zero, with no flow across streamlines.

In a cylindrical vortex, centripetal accelerations and expanding pressure waves interacting with the perimeter wall force the high-pressure pulsations outward and they get entrained with the sustaining circulation stimulus. Due to the opportunity for increased path lengths, overlapping and blending streamlines from previous circulating fluids, and pressure and velocity gradients, the pulsations may be reduced and elongated to make the system quieter at the output of the entire muffler. The combination of all of these effects act as a low-pass filter. Removing as much pressure fluctuations without introducing turbulent noise in the process creates an enhanced muffler, with increased sound suppression.

FIG. 1 illustrates a two-stage muffler 10 comprising a tangential input 12 and an axial output 14. The two-stage muffler 10 has an outer metal housing body 16 with a tangential input flange 18 and an axial output flange 20 to connect to an engine's manifold and exhaust pipes, respectively. The flange 22 connecting the first and second stages 24, 26 does not contribute to the functioning of the muffler 10, but may be used to test the first stage 24 independently and then both stages 24, 26 together. The mating flanges 22*a*, 22*b* (collectively flange 22), with thermal pressure gasket 94 (shown in FIG. 5), may be joined using bolts, for example, but may be removed and the sections of the first and second stages 24, 26 may be welded together or the entire muffler 10 may be made from one longer continuous cylindrical outer shell housing body 16.

In an example, at least 1/16th to 3/16th-inch steel may be used for sheet metal fabricated parts. The thicker the material, the more rigid the performance and less through-the-wall noise emanations. However, thicker metal increases material and fabrication costs, and adds additional weight. Any materials that may withstand the pressure, temperature, corrosiveness and vibrations may be used, such as steel, aluminum, titanium and inconel.

Figure 2:
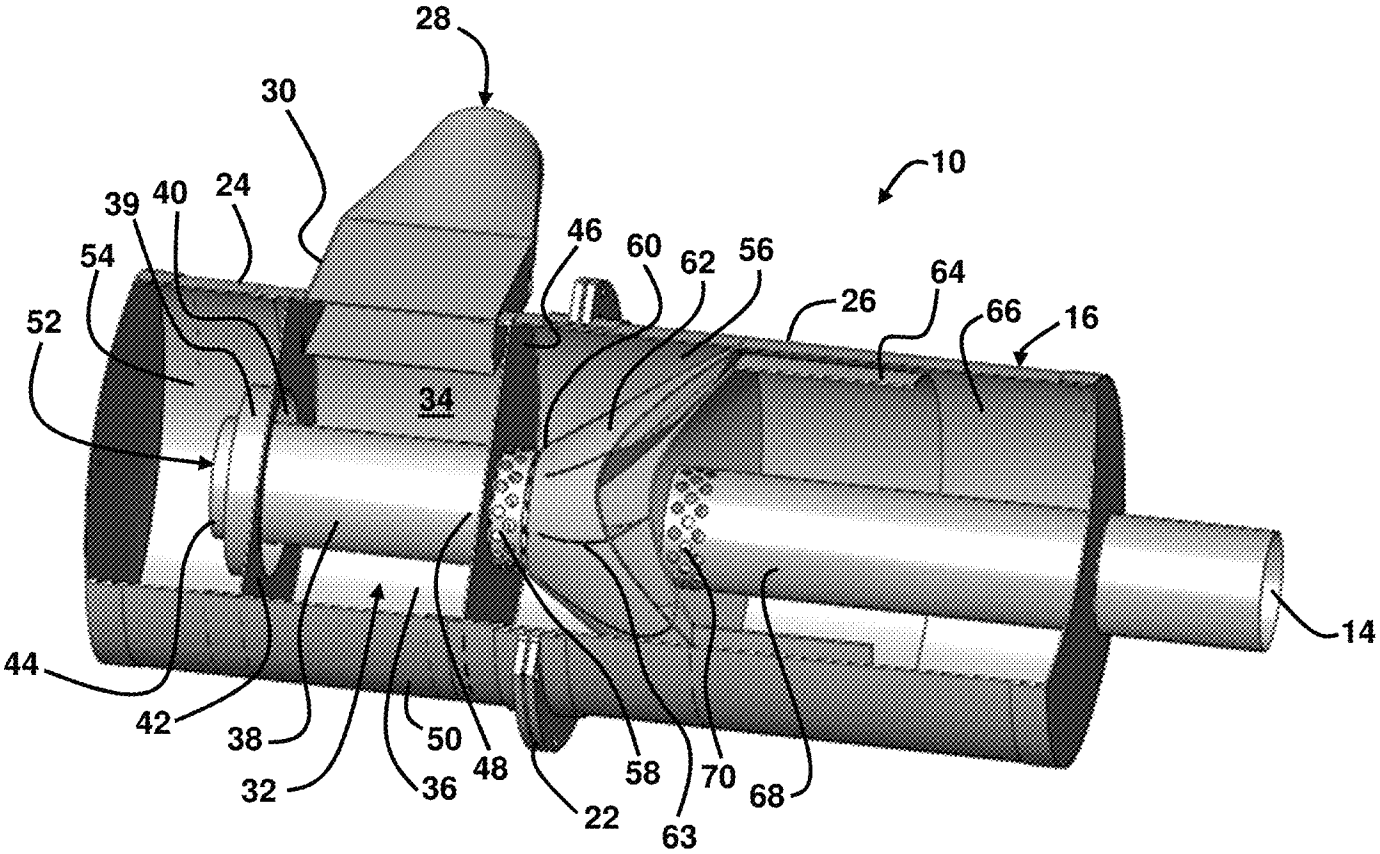
FIG. 2 illustrates an open view of the two-stage muffler of FIG. 1 without helix and spiral vorticity enhancers, according to an embodiment herein.

FIG. 2, with reference to FIG. 1, illustrates a section view of the two-stage muffler 10 without helix and spiral vorticity enhancers. The first stage 24 is the input to the muffler 10. The engine's exhaust enters the muffler 10 tangentially through the round-to-rectangular adapter 28. The low-profile rectangular input jet component 30 is configured to spread out the gasses over a larger area and direct the incoming gasses tangentially into the inside (e.g., vortex chamber 32) of the outer containment cylinder (in this case, it is the outside shell body 16). The height and width of the rectangular input jet component 30 contributes to the input impedance and velocity of the exiting flat jet of gas. This single large rectangular input jet component 30 may be broken into multiple smaller channels for flow straightening or to vary the flow rates across the expanse for additional nonuniform combination of flows along the outer perimeter as they circulate, merge and entrain nearby flows.

The tangentially injected flow is configured to flow along the inner perimeter surface 34 of the cylinder wall 36 with fluctuating path length, due to the pulsating variations in pressure and flow from the pistons at different revolutions-per-minute (RPM) and engine loading pressures. Within this vortex flow, the higher pressure and lower velocities are farthest radially from the center of rotation. The higher velocity, but lower pressures are closest to the center of rotation; in this configuration, high velocity, but lower pressures, are vented through the circular opening 40. The highest pressures and pressure pulsations, which contribute to the acoustic noise, are held artificially longer at the outer radius of the cylinder wall 36.

The gasses will continue to circulate outside of the egress pipe 38, which may be positioned in the center-line axis of the first input stage 24. The output of this stage is through a circular opening 40 between the egress pipe 38 and the sidewall 42 positioned at a first end 44 of the egress pipe 38. A flange 39 surrounds a portion of the egress pipe 38 near the first end 44 and abuts the sidewall 42. The flange 39 may comprise a groove 41 (shown in FIG. 5) aligned with the circular opening 40. The circular sidewall 46 positioned at a second end 48 of the egress pipe 38 is solid, without an exit port in this embodiment. If desired, ports, pipes, or channels may be configured in the solid circular sidewall 46 to capture and pass portions of the circulating fluid from different radii and combine it out of phase at a different location.

These gradients of pressure, velocity and temperature help create a low-pass filter to reduce noise. In the electrical analogue, an LRC is a low-pass filter, where L is the inductor length, R is the resistance, and C is the capacitance. Using the fluid analogy for this muffler 10, the path length is the inductance, the volume is the capacitance, and the exit coefficient is the resistance. The "inductance" is increased in length by enabling multiple passes around the inner perimeter surface 34 of the cylinder wall 36. The "capacitance" is increased by creating a pressure gradient and maintaining higher pressures longer at the radial periphery, and due to the momentum established through sustained circulation. The "resistance" may be artificially increased due to the resistance of certain portions of the highest pressure pulses to leave via the innermost exit region. Decreasing the area of the exit will also increase the resistance, but also contributes to increased engine backpressure. Dimensional tradeoffs between the cylindrical volume, circulation lengths and exit orifice area may change the low-pass frequency, thereby changing the acoustic emissions. The ultimate goal is to create a low-pass frequency of zero Hertz, or flow without any pressure perturbations. Preferably, the low-pass frequency should ultimately be configured to only pass infrasound; those frequencies below 20-Hertz which are inaudible to humans. However, these infrasound frequencies travel the furthest in atmosphere due to negligible absorption, and may couple to buildings or structures to create vibrational noises. Careful configuration adjustments may also target specific frequencies of significant annoyance or those most commonly emitted from an engine.

Centripetal acceleration forces the gasses outward and to become entrained with the existing sustained circulation. The highest pressure pulses have the opportunity to expand and impact the outer wall 50 of the first stage 24 and sidewalls 42, 46, and are kept further away from the exit region (i.e., opening 40) of the circular sidewall 42. Those portions of the exhaust waveform with higher pressure or flow velocity would travel slightly further than lower pressures and flows. The pulsating gasses are forced to expand radially and outward to the circulating flow regions, and asymmetrically adds with other portions of previous and future flow conditions. Due to the significant radial differences in the angular velocities (inner faster than outer), there is a velocity blending effect on the pressure pulsation for the portion of exhaust gasses entering the central circular opening 52 of the egress pipe 38. The tangential input flow sustains circulation in the vortex chamber 32, creating a radial gradient of pressure, velocity and temperature. These gradients further create acoustic diffraction within the muffler 10 to break up acoustic waves and contribute to the averaging of pressure, velocity and temperature through flow interaction over multiple revolutions.

Centripetal acceleration of the circulating gasses continues to force gasses outward, and radiant heat losses at the outer shell body 16 may further reduce pressure pulsations by removing heat through conduction. Although not shown in the drawings, heat sinks on the outside of the shell body 16 may enhance radiant heat transfer to the atmosphere.

Once the gasses leave the input stage's vortex chamber 32, another opportunity for regenerative circulation and gas expansion may occur at the endcap region 54. The flow then enters the center-line egress pipe 38 to go to the midsection region 56 of the second stage 26 of the muffler 10. The holes 58 shown near the end 48 of the egress pipe 38 of the first stage 24 creates an expansion zone in the midsection region 56 into the volume created by the outer shell body 16, the first stage circulation sidewall 46 and the cone 60 of the turbine-like fin channels 63. Because the holes 58 will allow omnidirectional expansion into this region 56, this is more of a passive expansion chamber with minimal residual circulation. Replacing the holes 58 with louvers, impellers, or channels would create circulation within this region 56 for additional noise reduction. This may also be a good location for optional vortex diodes (not shown) to permit pressure and flow to easily enter this chamber (e.g., region 56) but have more difficulty exiting back into the center-line egress pipe 38 due to the vortex diode's hysteretic flow resistance. Using a vortex diode to maintain an elevated pressure in this region 56 may enable ports, channels, or tubes to vent some of this higher pressure into other regions or to accelerate vortex flow in other circulation chambers. Materials such as fiberglass batting may fill portions of this void to absorb pressure pulsations and particulate, but also introduce a requirement to eventually replace that noise abatement materials as they degrade or fill with particulate.

After the pressure pulsations reenter the center-line egress pipe 38, all the exhaust gas is forced to flow into the truncated cone 60 and through the spiral fin channels 63 created between the nested cone vanes 62. The spiral channels 63 of the nested cone vanes 62 force the gasses to expand radially while momentum also forces them along the cone 60. The gasses then exit the spiral channels 63 tangentially, thereby creating contained-circulation between the outer shell body 16 and an internal cylindrical sleeve 64. The area between these the sleeve 64 and the outer shell body 16 of the second stage 26 is intended to maintain and reinforce circulation before the gas has an opportunity to expand into the large volume chamber 66 of the second stage 26. The volume chamber 66 is considered large compared with either the vortex chamber 32 or the endcap region 54 or a combination of both. As further described below, there are innumerable combinations of channel configurations and impeller fin exit configurations which may be used in accordance with the embodiments herein. The spiral channels 63 change the direction of the axial flow to a tangential flow, and create multiple jets of high-velocity gasses flowing tangentially along the outer periphery, thereby creating vorticity between the sleeve 64 and the outer shell body 16. The spiral channels 63 may comprise uniform or non-uniform cross-sectional sizes/areas and lengths.

A large, passive volume by itself acts as an expansion region to quiet pressure pulsations. By introducing circulation within this volume chamber 66 that was created by the nested-cone-vanes, additional noise reduction may occur within this large chamber 66 as describe previously. This configuration also has a central egress pipe 68 with holes 70 at the apex of the concave cone section 60. The innermost rotating flow enters the egress pipe 68 while the outermost flow continues to circulate. Residual circulation may continue within this egress pipe 68 at it leaves the muffler 10. As before, the holes 70 may be replaced with slots, helix, louvers, vanes or other geometries to enhance circulation within the egress pipe 68. Similar features may be inserted into the egress pipe 68 to create vorticity along the pipe 68 as it exits the second stage 26 of the muffler 10.

Either or both of these two stages 24, 26 described herein may be duplicated, rearranged, or reconfigured to increase the total noise attenuation of the muffler 10. Furthermore, numerous sections may be cascaded together with appropriate passageways to increase total attenuation. Accordingly, the embodiments herein are not restricted to any particular configuration.

Figure 3:
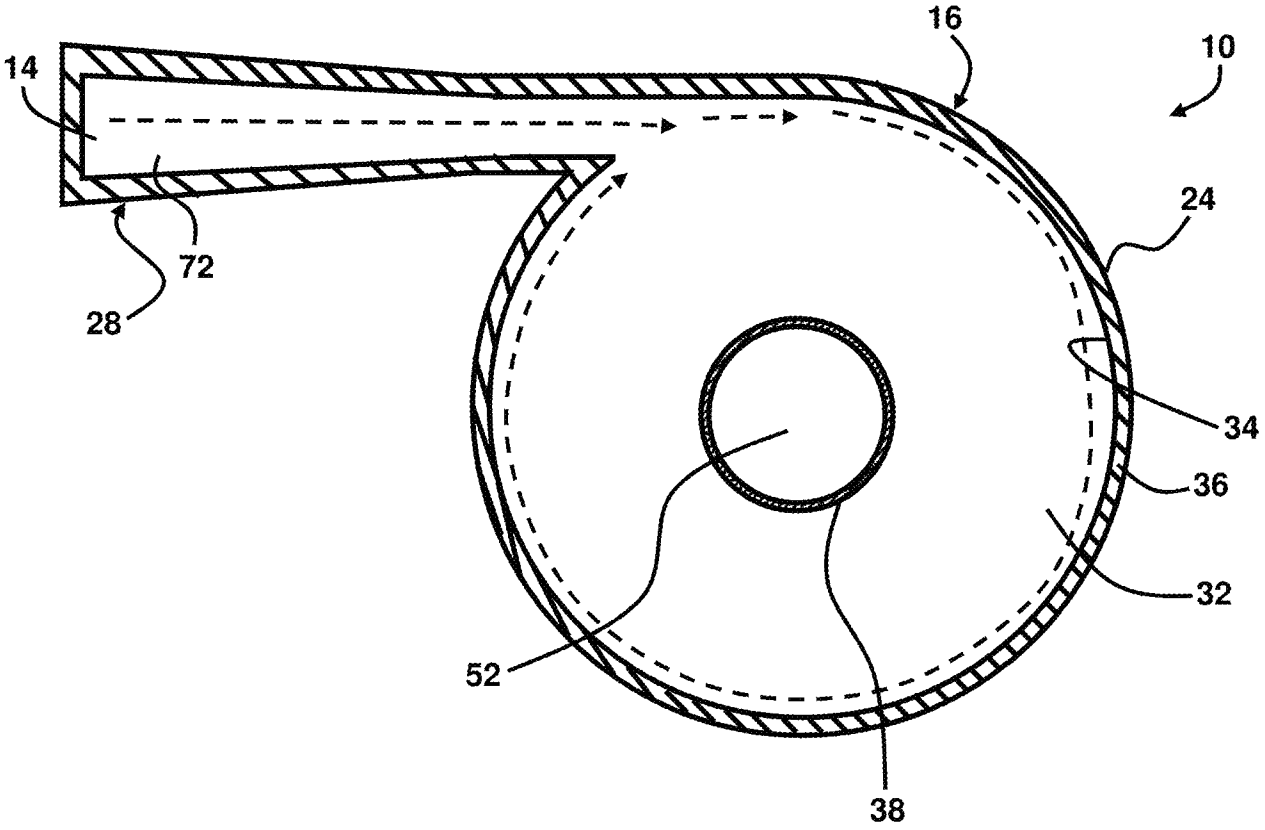
FIG. 3 illustrates a cross-sectional view of a first-stage input and circulation region of the two-stage muffler of FIG. 1, according to an embodiment herein.

FIG. 3, with reference to FIGS. 1 and 2, illustrates a cross-sectional view of the input of the first-stage 24 and circulation region (e.g., vortex chamber 32) of the muffler 10. This section view shows the tangentially injected flow of fluid and the flow of fluid (denoted by the dotted lines/arrows) along the inner perimeter surface 34 of the vortex chamber 32. The sidewall 42 has been removed from this view for clarity. This input configuration takes maximum advantage of the exhaust flow momentum coming from the engine manifold, and is the most effective way to convert the flow to vortex circulation because it does not require a change in direction. This tangential input configuration avoids bends in the body 16 or within the muffler 10, which adds flow resistance, increases impedance, and may create turbulent noise within the flow.

The cross-sectional view of the input plenum 72 of the adapter 28 transitions from circular to rectangular. Making the rectangular input to the cylinder low-profile of the vortex chamber 32 reduces the height of the linear jet and brings the jet to a more tangential orientation to the inner perimeter surface 34 of the circulation cylinder wall 36. Many combinations of widths and heights may spread out the inserted flow, but also effects the velocity. There is an optimal relationship between velocity and vortex diameter to ensure strong circulation. Lowering the height and increasing the width may match the impedance and flow restrictions of the round input plenum 72; for example, the $\pi r^2$=area of the circular portion of the adapter 28 matches the h×w=area of the rectangle portion of the adapter 28. Advanced formulas to calculate impedance and jet discharge coefficients may be applied, depending on the shape and dimensional ratios, for improved impedance matching.

This flat jet of fluid enters the cylindrical vortex chamber 32 tangentially. The gasses continue to circulate within the vortex chamber 32 and outside of the egress pipe 38 in the first stage 24 of the muffler 10. As described above, the output of the first stage 24 is the circular opening 40 between the egress pipe 38 and the sidewall 42 shown in FIG. 2.

The optimum geometry would ensure the gasses are injected tangentially and that the vortex chamber 32 is without perturbations which might create turbulent noise. Optionally, a curved metal section may be added internally to the adapter 28 to reduce the abrupt injection nozzle obstruction, and help blend as smoothly as possible the already clockwise circulating flow with the new incoming tangential flow. The innermost portion of the plenum geometry shown may be reduced to further reduce the flow blockage from the input plenum 72. However, this may also reduce the effectiveness of the input plenum 72 to create a thin tangential jet as close to the periphery wall as possible; potentially allowing more omnidirectional expansion than tangential jet insertion.

Optionally, the egress pipe 38 may be removed, and the exit port of the vortex chamber 32 may simply be a smaller diameter hole in the center of the round sidewall 42. The opposing face may be a round plate without a port, and therefore all gasses would need to exit through the smaller diameter hole in the center of the opposite wall. This provides a vortex diode configuration. Alternative configurations may have egress pipes on both sidewalls 42, 46 to divide the exit flows and redirect them to other portions of the muffler 10. Moreover, the two pipes 38, 68 may have two different diameters to further change the exit impedance characteristics to create dissimilar pressure pulsation signatures.

Figure 4B:
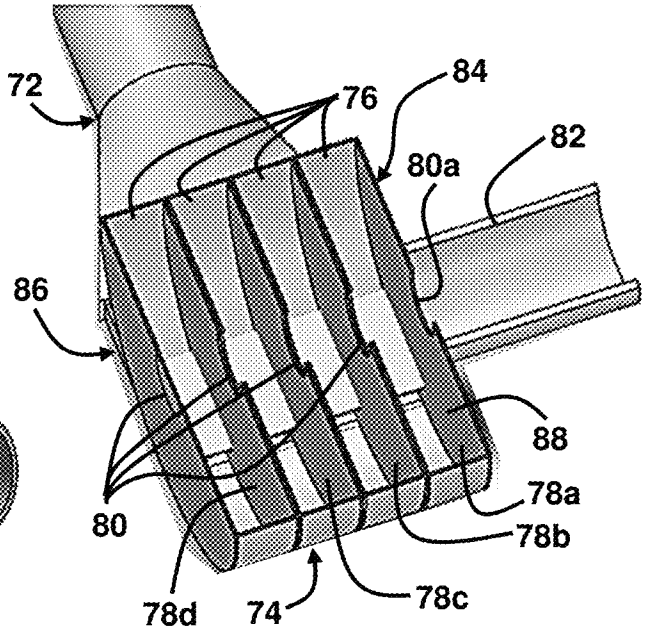
FIG. 4B illustrates a cross-sectional view of the alternate vortex chamber of FIG. 4A, according to an embodiment herein.
Figure 4A:
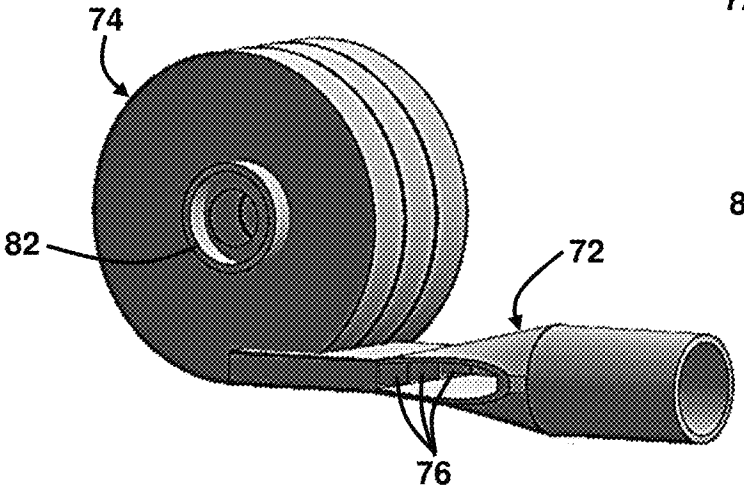
FIG. 4A illustrates a perspective view of an alternate vortex chamber, according to an embodiment herein.

FIGS. 4A and 4B, with reference to FIGS. 1 through 3, illustrates an alternate vortex chamber 74 of the input stage 24 into multiple rectangular inputs 76 with independent vorticity chambers 78*a*-78*d*. In this case, the rectangular input from the plenum 72 is divided into multiple (e.g., four, in an example) independent uniform flows before each enters one of the four cylindrical circulation chambers 78*a*-78*d*. Non-uniform divisions of flows at the rectangular input plenum 72 to the circulation chambers 78*a*-78*d* creates different velocities within the connected cylindrical vortex chambers 78*a*-78*d*. These chambers 78*a*-78*d* may also have different volumes or radii so that the vortex flow in each is different. Furthermore, although the central vent or port 80 of each of these chambers 78*a*-78*d* are shown as uniform in FIG. 4, variations to the summing of flows from each of the chambers 78*a*-78*d* may be modified by changing the diameters of each of these central passageway port 80.

As flows exit one chamber through the central port 80 with residual circulation, there are numerous opportunities for recirculation and entrainment with the flows existing in adjacent chambers 78*a*-78*d*. Ultimately, in this embodiment, the chambers 78*a*-78*d* all exit through the final central port 80*a* to a single egress pipe 82. Some of the chambers 78*a*-78*d* interact with adjacent chambers more than other chambers. For example, a large portion of the chamber 78*a* closest to the egress pipe 82 will exit flows directly into the pipe 82, with only a small portion of the chamber flows interacting with other interior chambers 78*b*-78*d*. Conversely, the chamber 78*d* at the opposite end will interact with each of the other three chambers 78*a*-78*c* as its flows migrate to the egress pipe 82. These individual flows from the four vortex chambers 78*a*-78*d* may be individually maintained with four separate central passageways (not shown) near the center of circulation, and the four independent flows may be combined or used to feed four different subsequent sections of a muffler 10 for stimulation or sustainment of additional vortex chambers.

Although not shown in FIGS. 4A and 4B, each of the four chambers 78*a*-78*d* may be coupled to adjacent chambers at various radial distances through simplistic holes or directionally dependent channels that may help average or reinforce different circulation velocities in adjacent chambers. This has the effect of averaging different flow velocities and pressures at the same radial distance from the center of rotation, and thereby either enhancing or reducing the flows in adjacent chambers, which will further average out pressure pulsations and flow perturbations which contribute to the ultimate acoustic emanations.

Although FIGS. 4A and 4B show the egress pipe 82 on only one side 84 of the vortex chambers 78*a*-78*d*, an additional egress pipe (not shown) may be located on the opposite side 86 to allow bidirectional exhaust flows into sections on both sides 84, 86 of the vortex chamber 74. This also decreases the impedance.

Additionally, the noise cancellation effect is greatest when the inputs 76 are oriented as tangentially as possible to the inner perimeter wall 88 of the circulation chambers 78*a*-78*d*. There may be instances when a user might want to change the acoustic signature or backpressure characteristics of the muffler 10; i.e., needing additional torque or power without concern for noise. This may be accomplished in many ways within the context of the embodiments herein. For example, the input jets may be reoriented to point toward the center of the chambers 78*a*-78*d* rather than the preferred tangential orientation. By doing this, no circulation will be created within the chambers 78*a*-78*d*, and the exhaust gasses will passively expand in the cylinder chamber 74 and exit much quicker through the center exit ports 80. Alternatively, a series of deflector baffles (not shown) with either a mechanical lever or electromechanical actuator may be located near the input jet openings to direct the flow towards the center of the chamber 74. Another way to change the overall impedance of the muffler 10 may be mechanically changing the pitch or angle on the vanes, thereby either increasing or decreasing the amount of circulation induced or the injection angle with respect to tangential and longitudinal directions of the inner perimeter wall 88.

Since the noise attenuation and backpressure both are influenced by the center dimensions of the egress port 80, a mechanism may be used to vary the dimensions of the port 80 may also control the performance of the vorticity muffler 10. For example, a mechanical or electromechanical mechanism to move a smaller or larger orifice into the egress location may selectively choose a range of performance for the noise reduction, backpressure, MPG, torque, and horsepower of the muffler 10.

Figure 5:
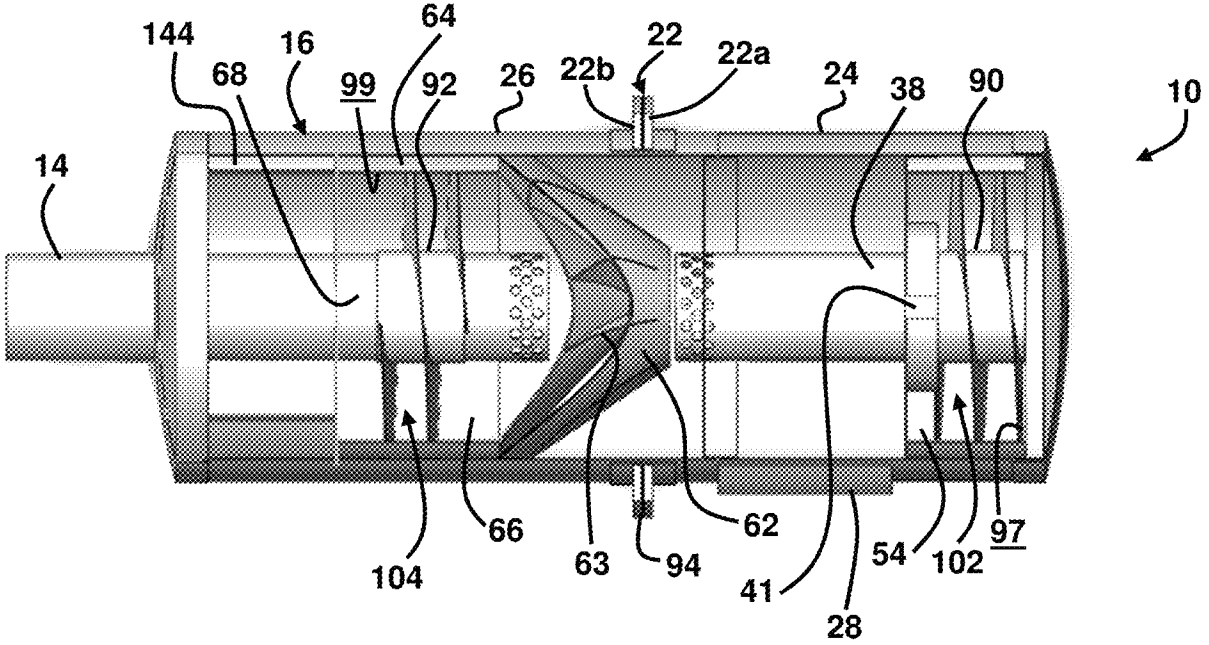
FIG. 5 illustrates a section view of a two-stage muffler including two helix and spiral vorticity enhancers, according to an embodiment herein.

FIG. 5, with reference to FIGS. 1 through 4B, illustrates a cross-sectional view of a two-stage muffler 10 including two helix and spiral vorticity enhancers 90, 92. Additional features may be added to various regions of the muffler 10 described above. The addition of two helix components 90, 92 and a spiral flow director 102, 104 take advantage of the extra volume available at the endcap region 54 of the first stage 24 and the large volume chamber 66 of the second stage 26. The rotational direction of the nested-cone vanes 62, the two helix components 90, 92 and the spiral flow director are configured so that the rotational direction of gasses throughout the entire muffler 10 is the same. This helps reinforce circulation from one section or feature to the next, and lends itself to more laminar flow throughout the muffler 10. Abruptly changing the rotational direction would likely cause additional turbulence, which would manifest itself as noise downstream and as the turbulence interacts with other internal mechanical features.

Figure 6:
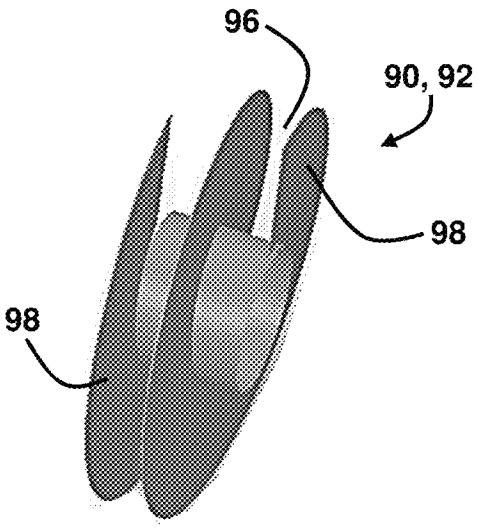
FIG. 6 illustrates a helix flow passageway for enhancing vorticity in subsequent chamber areas, according to an embodiment herein.

FIG. 6, with reference to FIGS. 1 through 5, illustrates a helix flow component 90 or 92 for enhancing vorticity in subsequent chamber areas. This helix component 90, 92 provides a low-resistance path to create additional circulation. Centripetal acceleration forces the gasses outward as it flows through the channel 96 created between the blades 98 of the helix component 90, 92, the inner surfaces 97, 99 of the endcap region 54 and chamber 66, respectively, and the inner egress pipes 38, 68. This example shows two complete flat blade revolutions 98 of uniform separation. The blades 98 do not have to be flat, and may have some curvature to them. The helix component 90, 92 may also have linearly varying gaps so that the area of the channel 96 increases or decreases as the gasses pass therethrough. Reducing the cross-sectional area of the channel 96 will force a higher velocity and therefore more radially outward pressures through centripetal acceleration, but will also add additional flow resistance that affects backpressure. Once the gasses leave the helix component 90, 92 into an expansion chamber with significant velocity and outwardly expanding pressures, it will initiate circulation in the expansion volume. The helix component 90, 92 may have clockwise or counterclockwise twist.

Figure 7:
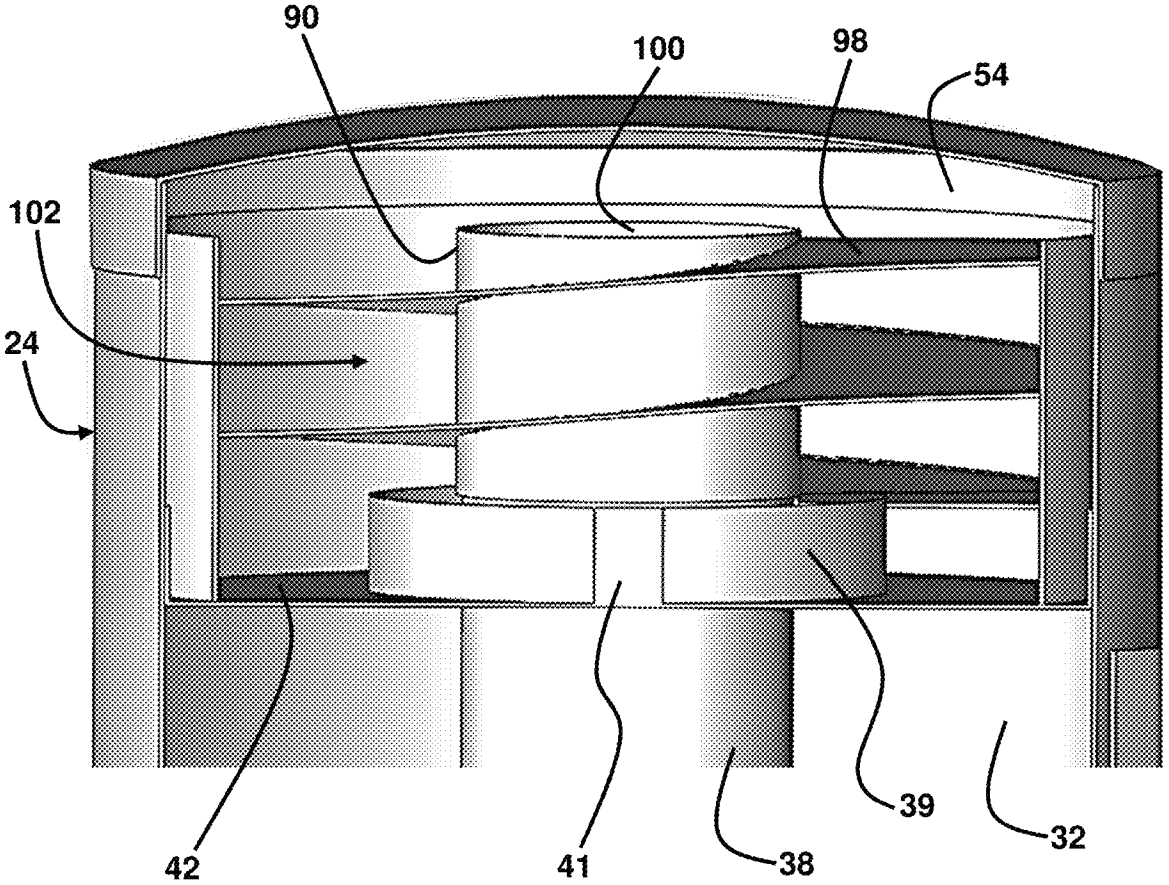
FIG. 7 illustrates a section view of a helix linking input circulation region and endcap transfer pipe, according to an embodiment herein.

FIG. 7, with reference to FIGS. 1 through 6, illustrates a section view of a helix component 90 in the endcap region 54 of the first stage 24 linking the vortex chamber 32 and egress pipe 38. This helix is located in the endcap region of the first stage. Once gasses leave the initial input section through the central, circular gap area 100, the gasses are forced to expand into the spiral region 102 created by the blades 98, travel through the spiral region 102, and then circulate in the volume between the endcap region 54 and the opening of the egress pipe 38. This additional vorticity at the endcap region 54 may reinforce the circulation throughout the entire length of the egress pipe 38. Direction of rotation may be changed, but is optimally the same direction as the vortex chamber 32 to minimize resistance, reduce impedance and minimize turbulent noise. If additional volume is available, such as with a longer muffler 10, another helix component may be added in series with a circulation region (not shown) therebetween. The helix component 90 may also be replaced with vanes, louvers, small angled pipes, or other mechanical geometries to similarly create circulation in the endcap region 54.

Figure 8:
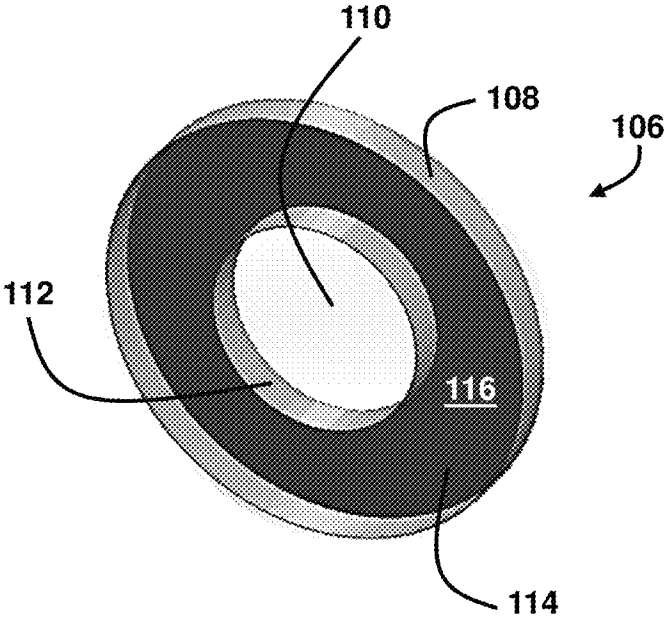
FIG. 8 illustrates a section of circulation region with an interior wall, according to an embodiment herein.

FIG. 8, with reference to FIGS. 1 through 7, illustrates an example of a section of a circulation region with an interior wall. For example, the outer and inner diameter flange 106 may be used as the sidewalls 42, 46 creating the vortex chamber 32. The flange 106 may be used anywhere in the muffler 10 to create circulation channel regions. The flat wall 114 acts as a barrier between adjacent chambers and comprises a surface 116 that contains the pressure expansions and vortex flows within the chamber to which it abuts. The flange 106 includes a central aperture 110 which may surround an egress pipe (such as pipes 38, 68). The flange 106 comprises an outer ring 108 defining an outer perimeter of the flange 106 and an inner ring 112 defining the outer perimeter of the central aperture 110. The wall 114 helps contain flow between the two rings 108, 112; the size of the rings 108, 112 may be increased to create a larger circulation containment chamber. The inner ring 112 creates an obstacle to exiting through the central aperture 110, and requires radial pressures to reduce even more before they may transfer to a subsequent section through the innermost port.

Figure 9:
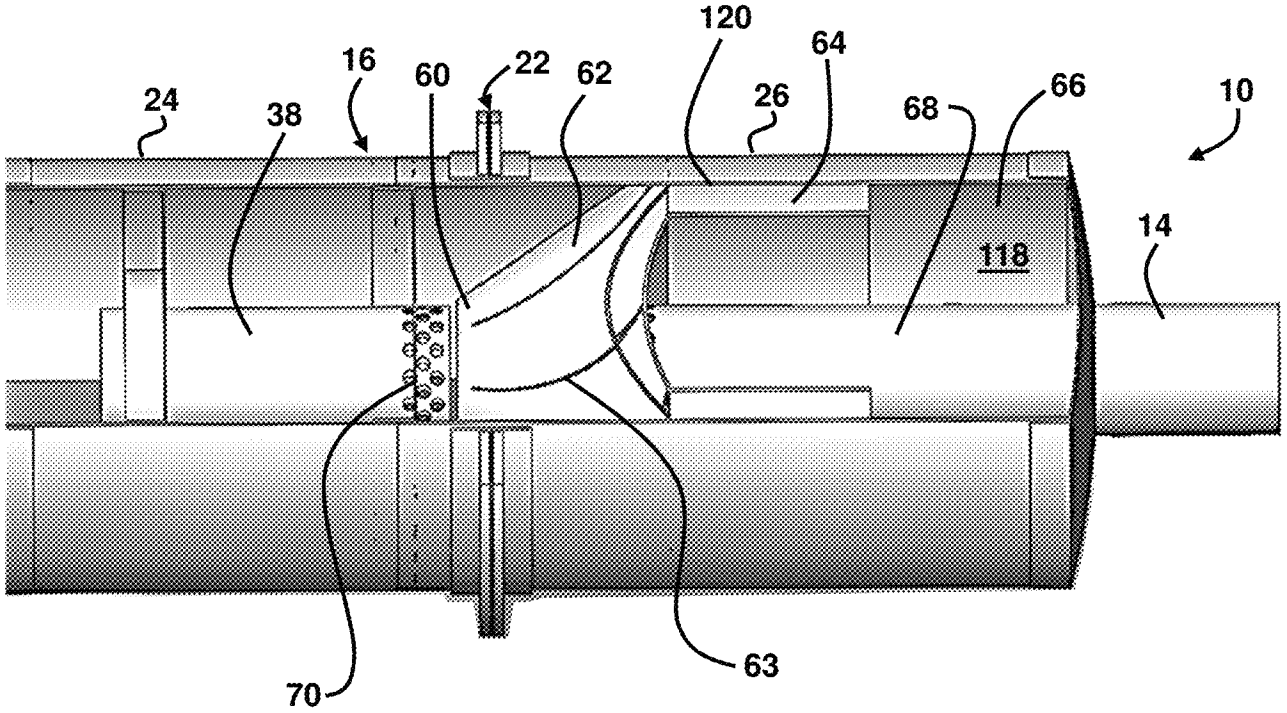
FIG. 9 illustrates a mid-section view showing a transfer pipe to nested fins within cone boundaries, according to an embodiment herein.

FIG. 9, with reference to FIGS. 1 through 8, illustrates a mid-section view showing a transfer of pipes 38, 68 to a truncated cone 60 and through the spiral fin channels 63 created between the nested cone vanes 62. This mid-section view highlights the nested cone 60 and fin channels 63 creating swirling channels leading to the outer cylindrical housing body 16. The pipe 38 introduces the flow into the truncated cone 60. The section-view cuts through the cone 60 to show that the vanes 62 and channels 63 that bend significantly to redirect the flow perpendicular to the axial pipe direction and in a tangential direction to the outermost perimeter of the housing body 16. These channels 63 terminate tangentially to the inside of the outer body 16 of the muffler 10, and create jets of fluid. Preferably, the streamlines of these jets would be as perpendicular to the centerline of the muffler 10 as possible so that more circulations may occur before exiting the region between the outer body 16 and the inner sleeve 64 attached to the cone 60.

These directed jets along the inner perimeter wall 118 of the body 16 of the muffler 10 create high-velocity jets distributed equally along the perimeter of the nested cone 60. The number of these vane channels 63 and terminating nozzle area between the tips of the vanes 62, as well as the gap 120 between the outer body 16 and inner sleeve 64, may all be modified to change the impedance of this section as well as the amount of circulation.

Figure 10B:
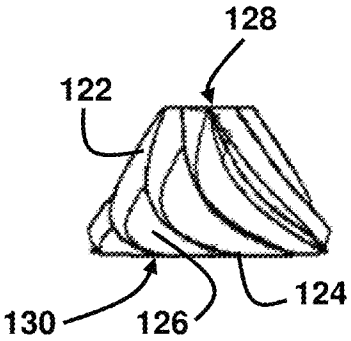
FIG. 10B illustrates a side view of exemplar vortex-inducing vanes mounted to a cone to create an outward and circulating channel flow, according to an embodiment herein.
Figure 10A:
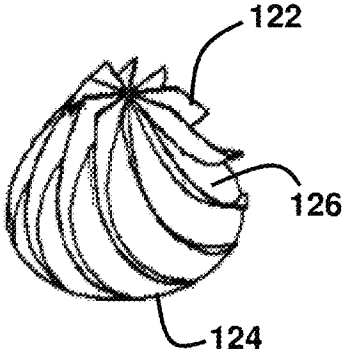
FIG. 10A illustrates a perspective view of exemplar vortex-inducing vanes mounted to a cone to create an outward and circulating channel flow, according to an embodiment herein.

FIGS. 10A and 10B, with reference to FIGS. 1 through 9 illustrates exemplar vortex-inducing vanes 122 mounted to a cone 124 to create an outward and circulating channel flow. The numbers, twist-ratios, heights of the channel-fins 126 and angle of the cone 124 may be varied significantly to modify the input impedance and exit velocity. The angle of the vanes 122 with respect to the cone 124 may be varied as well; perpendicular to the surface of the cone 124 to create more of a rectangular channel cross-section or at some angle to create more of a parallelogram. The vanes 122 may vary in height between the input and output regions 128, 130, respectively. The area of the exit of each channel 126 and the gap (e.g., between the outer shell body 16 and an internal cylindrical sleeve 64 of the muffler 10 of FIG. 2) may be varied to change the velocity and directivity of the nozzles created by the vanes 122. The exit of each channel 126 creates tangential flow and pressure deflections when directed to the inside of a cylindrical wall in order to create high velocity circulation within the containment cylinder, and circulate many times around the perimeter as the flow and pressure pulsations continue towards the next feature of the muffler 10. Equal propagation channels 126 will symmetrically inject velocity flows equally around the perimeter of the containment cylinder. Another embodiment of the muffler 10 may incorporate fins with varying combinations of lengths of channels non-uniformly terminating around the base of the cone 124, thereby creating asymmetrical path-length with out-of-phase pulsation additions in subsequent regions to further break up the periodic pulsation pattern from engine piston firing.

In the configuration shown in FIGS. 10A and 10B, the flow is introduced in the center of the fins at the point (e.g., region 128) of the cone 124, and the exhaust flows radially outward in the fin path. A different embodiment may have the exhaust enter in the outer diameter of the cone 124 and the fin channels 126 may force the exhaust gasses and pulsations inwardly toward the center of the cone 124 to have a higher velocity exit from the central region.

The method to create the flow channels may vary from the thin vanes 122 mounted onto the cone 124. Similar vanes may be mounted to a flat plate with similar vorticity effects. Round or rectangular pipe sections may be bent and distorted in cross-section to form circulation-inducing flow paths that also restrict flows and pressure leaks in undesirable paths. Although the vanes 122 describe so far have been mounted to a cone 124 to give it structure and effective channel geometries, there are many ways to create the swirling channels without a cone. For example, eight larger fins with unique shapes, such as bends and folds, may be welded together to form a composite base and channels in lieu of a cone. This would change the shape of the channel significantly, but would provide the same function of channel-flow redirection.

Figure 11:
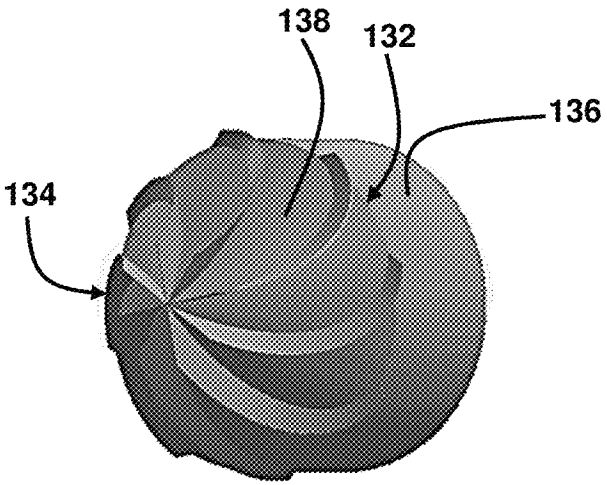
FIG. 11 illustrates exemplar vortex fins mounted to a conical deflector and cylinder, according to an embodiment herein.

FIG. 11, with reference to FIGS. 1 through 10B, illustrates exemplar vortex vanes 132 mounted to a conical deflector 134 and cylinder 136. The attached vanes 132 shift the flow to the outer perimeter of the cone 134 and create spiral flow downstream. A top-cover truncated cone (not shown) allows the flow to enter its center hole and feeds the upper ends of the vane channels 138 that are captured between these two cones. The vanes 132 capture the flow and force a significant change in direction and velocity; in this case intentionally inducing rotation of the flows. The output of the vanes 132 eject gasses tangentially to the inner wall 118 of the muffler 10. The vanes 132 may be replaced with folded metal, tube or channel sections bent to form the correct curvature.

Figure 12:
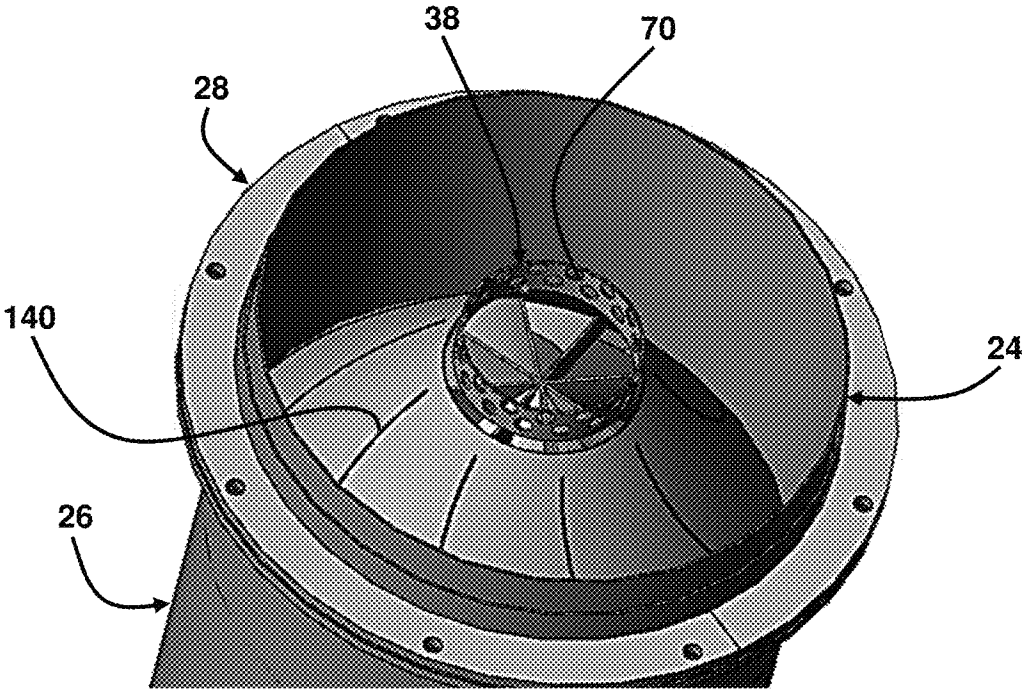
FIG. 12 illustrates an input to a second stage's conical fin section and the area of passive expansion region, according to an embodiment herein.

FIG. 12, with reference to FIGS. 1 through 11, illustrates an input to a conical fin section of the second stage 26 and the area of passive expansion region. The captured spiral vanes 140 between the cones are shown in this figure. The truncated cone accepts flow from the passive expansion region and from the egress pipe 38 of the first stage 24 of the muffler 10 described above. The volume shown above the visible truncated cone creates the passive absorber volume described between the first and second stages 24, 26. This volume may easily support additional pressure deflection or absorption features to make this void more effective.

Figure 13:
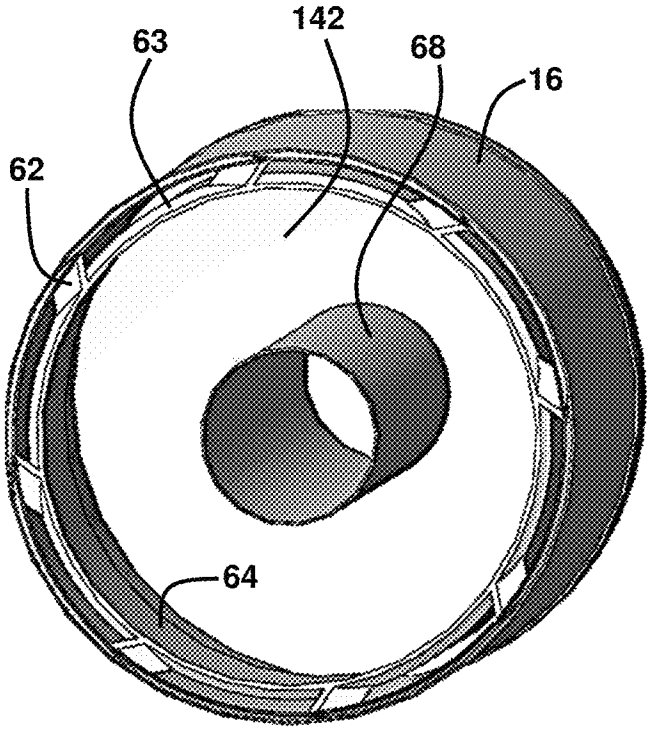
FIG. 13 illustrates a cross-section of nested cones with fin terminus into the region between two coincident cylinders, according to an embodiment herein.

FIG. 13, with reference to FIGS. 1 through 12, illustrates a cross-section of nested cones with fin terminus into the region between two coincident cylindrical chambers in the muffler 10. FIG. 13 shows the terminations of the vane channels 63 which feed the cylindrical void 142 created between the outer body 16 and the sleeve 64 (of FIG. 2). The higher velocity output of the channels 63 create tangentially circulating flow between the two cylindrical structures (e.g., outer body 16 and sleeve 64). The volume (e.g., cylindrical void 142) shown between the inner cone (e.g., channels 63) and the egress pipe 38 in this section view is a region that may support circulation. These circulating flows will migrate toward the next section through the egress pipe 38 shown at the center-line.

Figure 14:
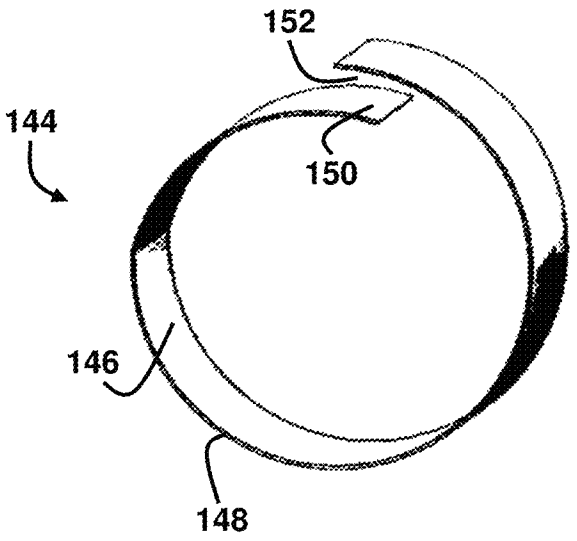
FIG. 14 illustrates a cross-section of a spiral deflector to create a circulation within the spiral region, according to an embodiment herein.

FIG. 14, with reference to FIGS. 1 through 13, illustrates a cross-section of a spiral deflector 144 to create a circulation within the spiral region 104 of the helix component 92 (of FIG. 5). Just like the first input stage 24 introduces tangential flow through the adapter 28 to force gasses to travel around the perimeter of the inner walls 36 of the vortex chamber 38, this spiral deflector 144 creates a passageway between the outer body wall 16 and the bent inward portion 146 of the spiral deflector 144. The particular spiral deflector 144 is fed axially by injecting flows parallel to the edges 148, rather than tangentially as seen before. An endcap prevents flow from passing all the way through the overlap gap. Pressurizing the void formed between the overlap region will force gasses through the gap 152 formed between the inner and outer portions 146, 150 of the spiral deflector 144. This creates a thin linear jet along the slot that tangentially follows the inner perimeter to create vorticity in the interior; the height of this jet is a function of the separation distance between the overlapping sections. This circulation may then feed the next stage of the muffler 10. Multiple spiral deflectors 144 with similar or varied gaps 152 may be distributed along the inner diameter of the outer body 16 to create multiple linear jets of flow.

Figure 15:
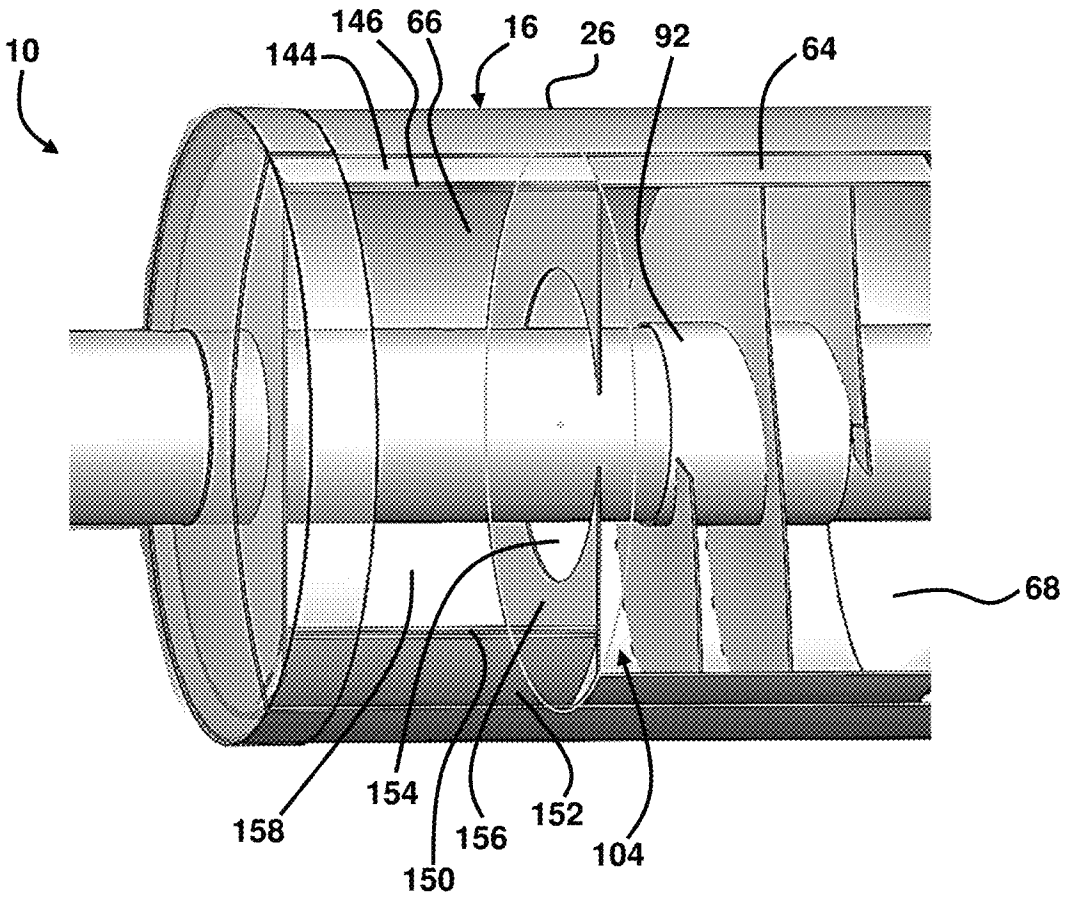
FIG. 15 illustrates a section view of a terminal helix and spiral, according to an embodiment herein.

FIG. 15, with reference to FIGS. 1 through 14, illustrates a section view of a helix component 92 and deflector 144 in the second stage 26 of the muffler 10. Flow originating from the nested cone vanes 62, between the body 16 and sleeve 64 and into volume chamber 66 of the second stage 26, will flow into the void 152 created by the spiral overlap section (e.g., between outer portions 146, 150), and exit into the interior of the spiral region 158 with tangential flow creating vorticity. The circulation within the spiral section 158 exits via a central circular gap 154 between an endplate 156 and the terminal egress pipe 68. The flow then enters a second helix of this configuration, before entering a void section 104 of the volume chamber 66 as vortex flow.

The single spiral deflector 144 may be replaced with multiple partial spirals distributed either uniformly or asymmetrically with similar or varying lengths for force deconstructive signal addition due to phase variations created by differing path lengths. The helix component 92 may be replaced with louvers, fins, or channels to create additional circulation downstream.

Figure 16:
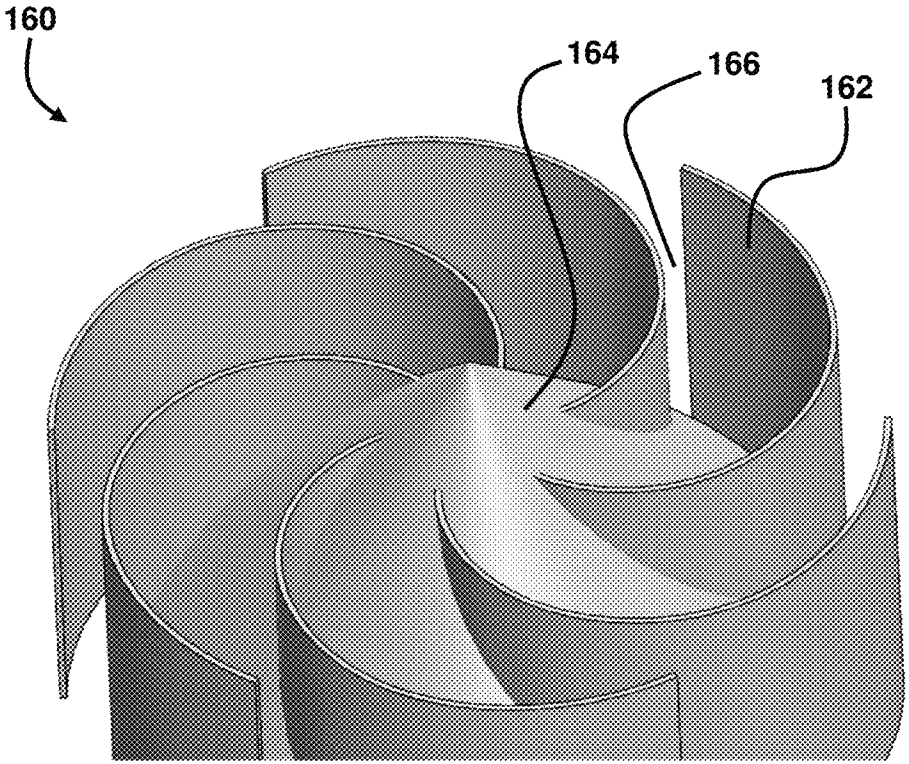
FIG. 16 illustrates merged fins with a cone for inducing circulation, according to an embodiment herein.

FIG. 16, with reference to FIGS. 1 through 15, illustrates an assembly 160 comprising a plurality of merged vanes 162 with a cone 164 for inducing circulation in the muffler 10. The integration of curved channels 166 with conical flow deflectors enables the transition of a linear flow to a vortex flow. The cone 164 helps utilize forward momentum to further accelerate the gasses radially into the curved configuration of the vanes 162. This accelerates the flow along the vanes 162 for added benefit without adding additional turbulence. When the vanes 162 extend beyond the base of the cone 164 and seal at an outer cylindrical containment shell (not shown), the redirected gasses traveling down the cone 164 and through the channel 166 may be tangentially injected to the inner perimeter wall (e.g., wall 118 of the volume chamber 66) of the body 16 (not shown here). The components shown in FIG. 16 may be repeated multiple times in series within an elongated cylinder or pipe, with intermittent gaps for independent circulation regions to ensure sustained circulation between sections, and deflection mechanisms between sections to reintroduce flows to impinge the cone apex and central region.

Figure 17:
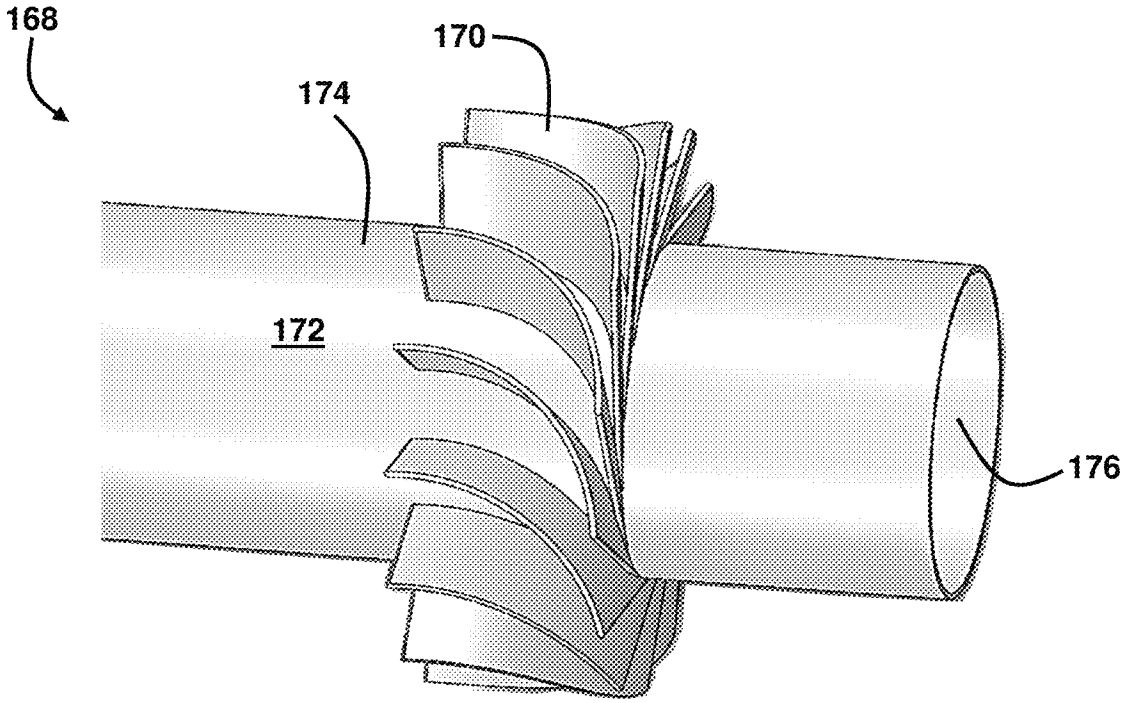
FIG. 17 illustrates fins on the outside of a tube, according to an embodiment herein.

FIG. 17, with reference to FIGS. 1 through 16) illustrates an assembly 168 comprising vanes 170 configured on the outside surface 172 of a tube 174. These exemplar vanes 170 convert longitudinal flows to tangential circulation perpendicularly around the tube 174. When the assembly 168 is concentrically centered within the outer cylinder body 16, vortex flows are created between the two cylinders 16, 174. In an alternate configuration, the vanes 170 may also be positioned on the interior of the passageways, such in the inside portion 176 of the tube 174.

Figure 18:
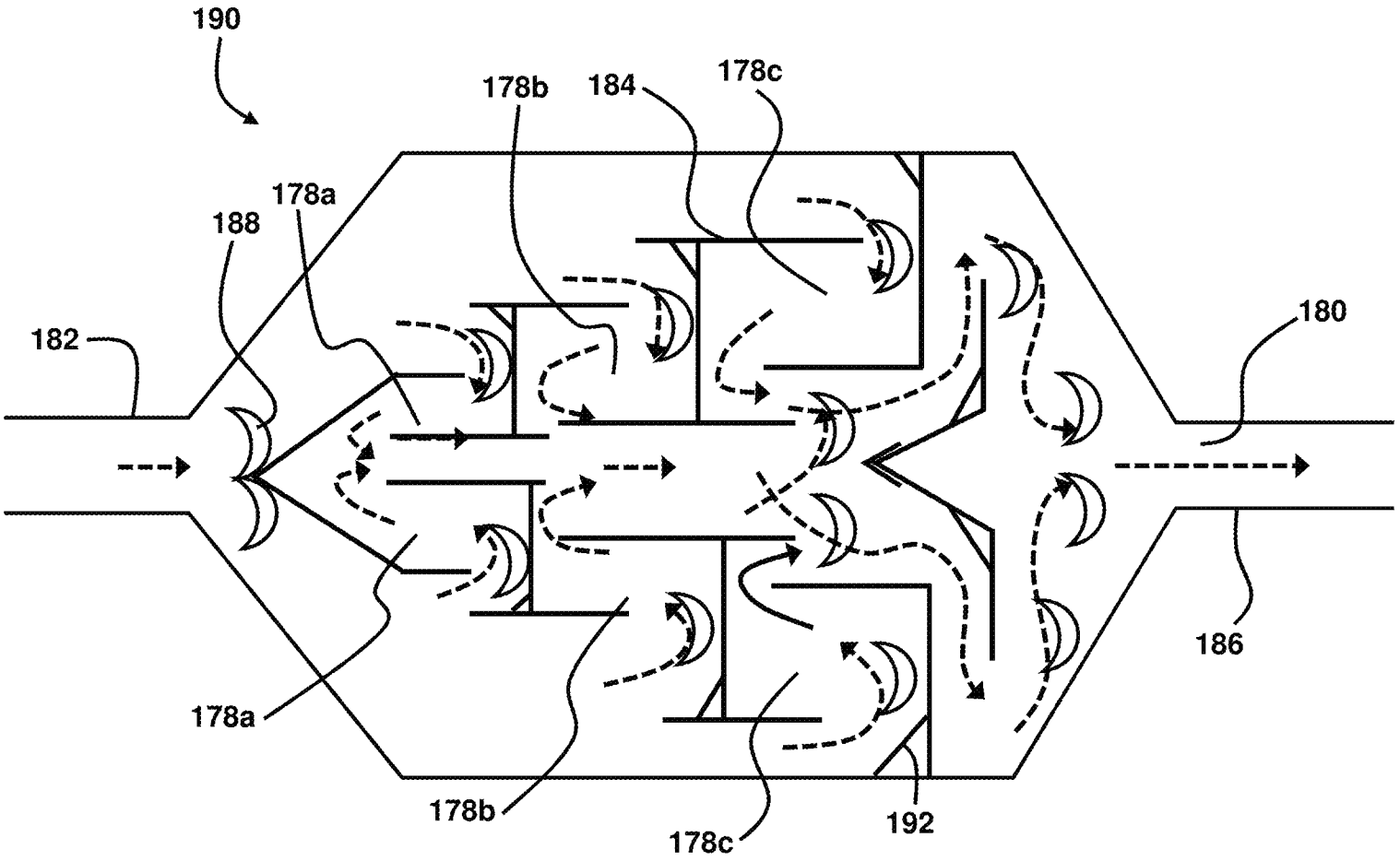
FIG. 18 illustrates a configuration for combining three different initial flow-combination paths feeding final junction of combined flows, according to an embodiment herein.

FIG. 18, with reference to FIGS. 1 through 17, illustrates a configuration for combining three different initial flow-combination paths or flows 178*a*-178*c* feeding a final junction 180 of the combined flows. FIG. 18 illustrates an example of multiple paths, vanes, and summation regions to induce circulation in interior cylindrical passageways in the muffler 10. The objective is to initially split the flows 178*a*-178*c* from the input pipe 182, feed them through several different sized vortex features 184, and reassemble the flows 178*a*-178*c* before entering a final vortex chamber 186. The crescent-shaped features 188 symbolically indicate some form of vanes, louvers, or deflectors to induce vortex flows on the downstream side of each device 190. The vortex-inducing features 184, 188 also provide mechanical structure by connecting walls to internal objects, and maintain the placement of the internal features in the device 190. This particular configuration of the device 190 is symmetric to the center-line and all walls forming vortex chambers are concentric. Although not always required, reflectors 192 are shown in some of the corners of the paths 178*a*-178*c* to indicate how flow and pressure pulsations may be redirected into the next sections with minimal losses.

This configuration exploits the concept of variable input impedances and circulation angular velocities at different stages, due to the diversity of cylinder diameters, cavity volumes and the number and curvature of vanes. Depending on the size of each input orifice (e.g., pipe 182) for the first three sections of divided flow, the ratio of circulation in each of the interior cylindrical vortex regions will rely upon the flow passage areas, resistance to flow from changing directions and the pipe passageway cross-sectional area between walls and regions. Adjustments to these feature configurations may modify the overall impedance of the entire muffler 10, or tune independent sections for flow balancing.

Figure 19:
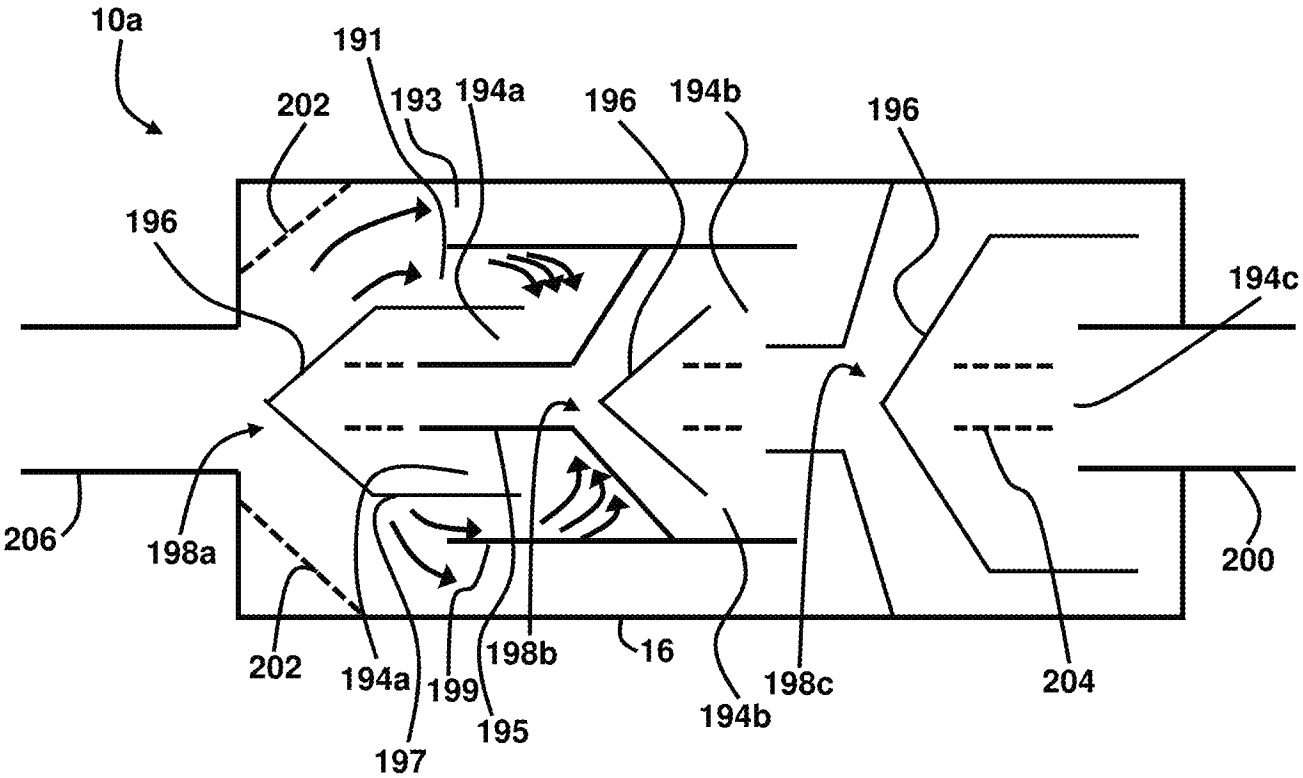
FIG. 19 illustrates a linear three section muffler with a combination of flows, according to an embodiment herein.

FIG. 19, with reference to FIGS. 1 through 18, illustrates a linear three section muffler 10*a* with a combination of flows. This embodiment is similar to the device 190 of FIG. 18, with only the first two sections 194*a*-194*b* being merged prior to the third stage 194*c*. Vortex-inducing vanes or fins 196 may be positioned at the expansion regions 198*a*-198*c* prior to each stage/section 194*a*-194*c*, respectively, as well as internally between the inner cylinders (e.g., between inner cylinders 195 and 197, between inner cylinders 195 and 199, and between inner cylinder 199 and housing body 16) and the egress pipe 200 on the center-line. Region 198*a* may comprise curved vanes (e.g., such as the vanes 162, 170 described with reference to FIGS. 16 and 17, respectively) attached to only one fin 196 to help direct flow outward and into the two channels leading to the first two circulation sections 194*a*-194*b*. The flow ratios of these two input channels 191, 193 may be adjusted to maximize circulation based on diameters of the individual vortex chambers.

Perforated baffles 202 may be placed at the entrance corner to create expansion chambers, with or without packing materials, in the wasted space, or this may be a double cone with curved fins between. The second two cone pairs would have the curved fins to create swirling channels. The perforated pipes 204 along the center-line may be welded to the cones to give additional strength and prevent vibration noises. The perforations may also be replaced with louvers or fins to induce circulation within the egress pipe 200. Additionally, the area, number, and spacing of the perforated baffles 202 may be varied to create impedance diversity.

The input pipe 206 is shown in this embodiment along the center-line and uses fins to create the initial vorticity. As described previously, any of these muffler embodiments may have the input oriented perpendicular to the longitudinal axis, and offset radially so that the input is tangential to the inside perimeter of the cylindrical regions feeding the first two stages. Doing so would create a much stronger initial circulation and reduce the input impedance by not abruptly going into the cone's fins.

Figure 20:
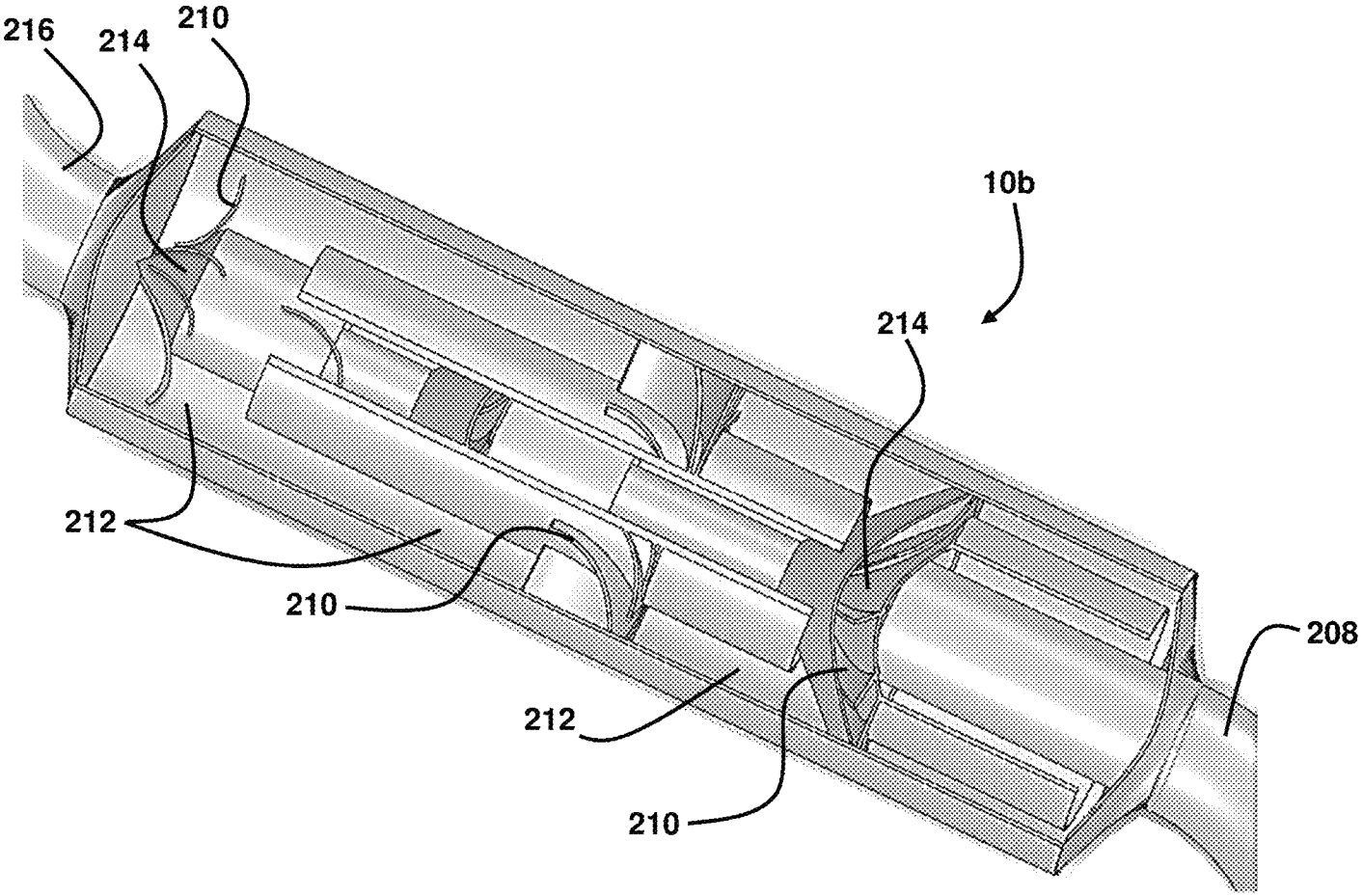
FIG. 20 illustrates an exemplar linear multipath circulator configuration, according to an embodiment herein.

FIG. 20, with reference to FIGS. 1 through 19, illustrates a muffler 10*b* containing exemplar linear multipath circulator configuration. This configuration shows multiple stages of fins 210 creating circulation at various stages of combinatorial flow passages 212. Diversity in cylinder diameters, channel lengths, vortex-containment volumes and vane numbers may create variations in the combination of pulsating flow from engines under diverse loads. Impeller-blade fins 210 nested between cones 214 may create channels to take flows from the central region of the muffler 10*b* to the outer regions. Multiple examples of reverse flow of the circulating exhaust gasses may be seen in this embodiment, some with or without vanes or fins 210 to create circulation within the cylindrical regions of the muffler 10*b*. In FIG. 20, the output and input pipes 208, 216, respectively, are axially oriented along the center-line. However, the input pipe 216 may be oriented perpendicularly to the longitudinal axis and introduce input flows tangentially, as described above with respect to the earlier embodiments.

Figure 21:
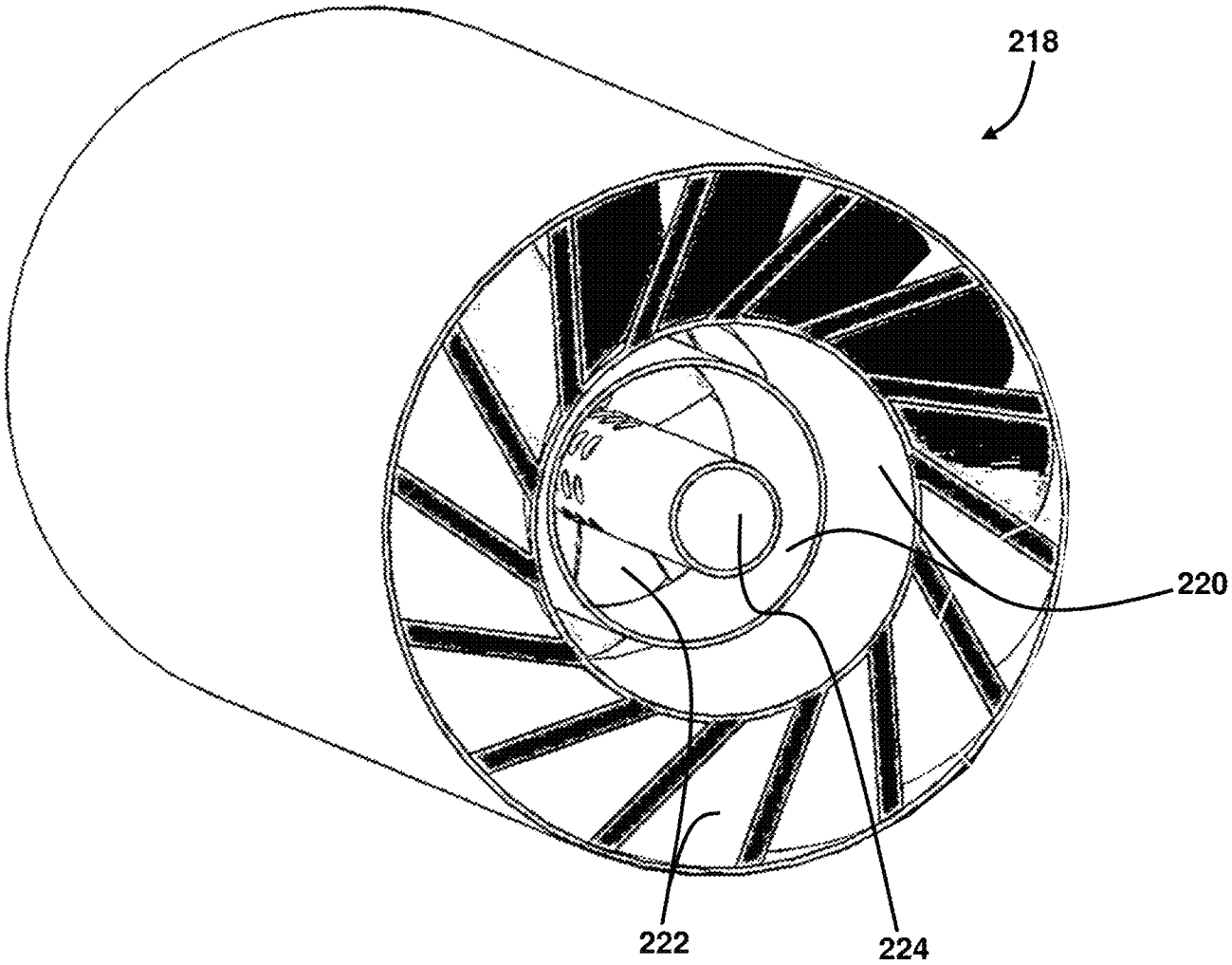
FIG. 21 illustrates nested cylinders with vanes creating circulation between the cylinders, according to an embodiment herein.

FIG. 21, with reference to FIGS. 1 through 20, illustrates an assembly 218 comprising nested cylinders 220 with vanes 222 creating circulation between the cylinders 220. Shown is an example of multiple, concentrically nested cylindrical flow paths with vanes 222 to induce circulation downstream of the impeller structures. This configuration shows two cylindrical flow passageways around an inner pipe 224, each with vortex-inducing vanes 222 of differing dimensions. Areas of each cylindrical passageway may be modified, as well as the number and size of vanes 222, may be varied to create differing degrees of circulation. Circulation may be contained between the inner cylinders 220, and these flows may be combined at any junction of flow passageways.

Figure 22B:
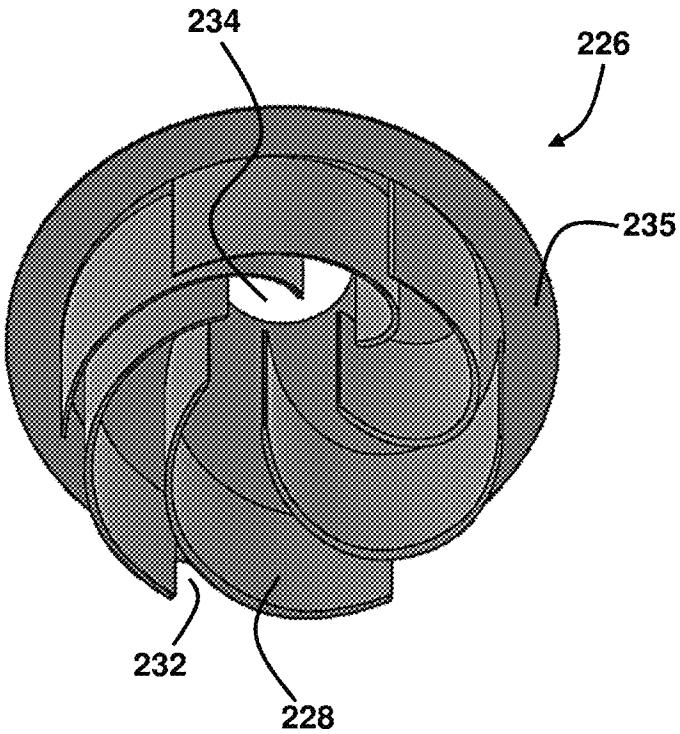
FIG. 22B illustrates a lower perspective view of a single stage of conical fins for stacking, according to an embodiment herein.
Figure 22A:
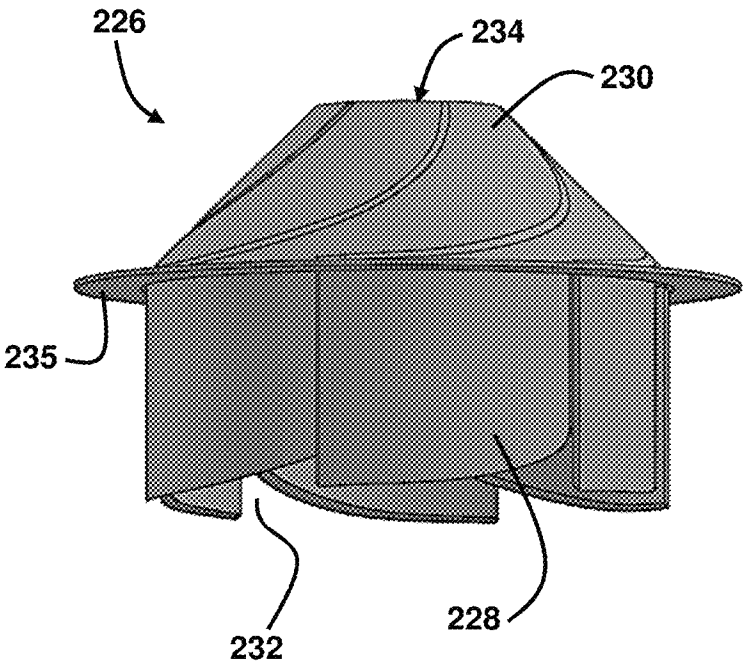
FIG. 22A illustrates a side perspective view of a single stage of conical fins for stacking, according to an embodiment herein.

FIGS. 22A and 22B, with reference to FIGS. 1 through 21, illustrate an assembly 226 comprising a single stage of spiral fins 228 for stacking. The cone 230 with spiral fins 228 are configured to be stackable within a cylindrical housing (e.g., volume chamber 66, for example). When stacked, the fins 228 of one stage are contained between two cones so that expanding gasses and pressure perturbations are forced into the spiraling fin channels 232, and are redirected into the circular void created between the fin tips and the outer cylindrical housing. It is preferable to ensure proper pressure seal to minimize pressure leaks between adjacent channels; seals may be from welds, sealants, gaskets or from advantageous sheet-metal folds. The port 234 in the apex of the cone 230 enables flow to be introduced into the center, and to feed multiple stages simultaneously through similar ports on successive stages. A flange 235 may be configured to separate the cone 230 from the fins 228 and to provide a base for subsequent nesting or stacking of additional assemblies 226 together. To promote more circulation and better flow through the entirety of stacked stages, vents or passageways may be incorporated into either the housing or the stage's flange, as may be seen in FIG. 23.

Figure 23:
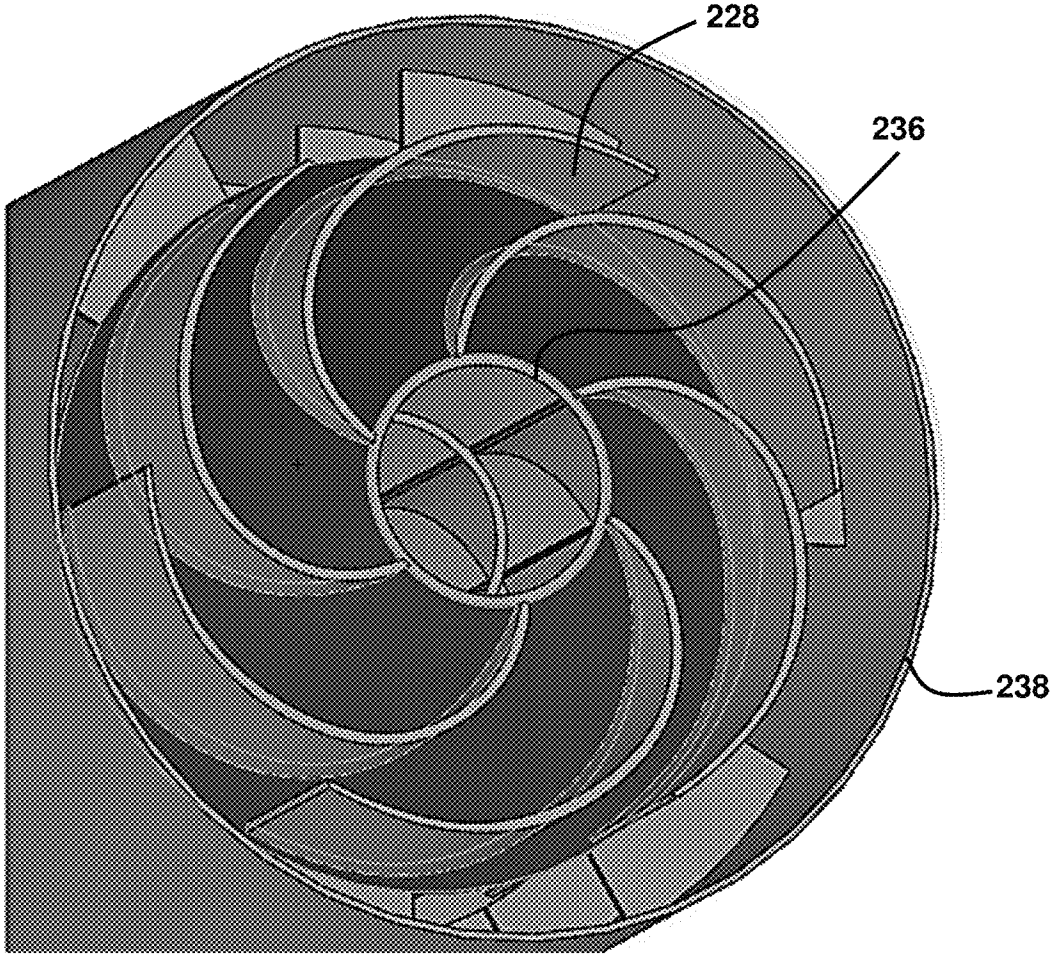
FIG. 23 illustrates nested vanes with a central feed and an inner-stage coupling at the outermost regions, according to an embodiment herein.

FIG. 23, with reference to FIGS. 1 through 22B, illustrates nested fins 228 with a central feed 236 and an inner-stage coupling at the outermost regions. Conical fins 228 are shown stacked within a cylindrical housing 238. The flanges 235 of each stage, which create concentricity within the cylindrical housing 238, are modified at the periphery to allow flow and pressure pulsations to pass from one stage to the next, if desired.

Figure 24B:
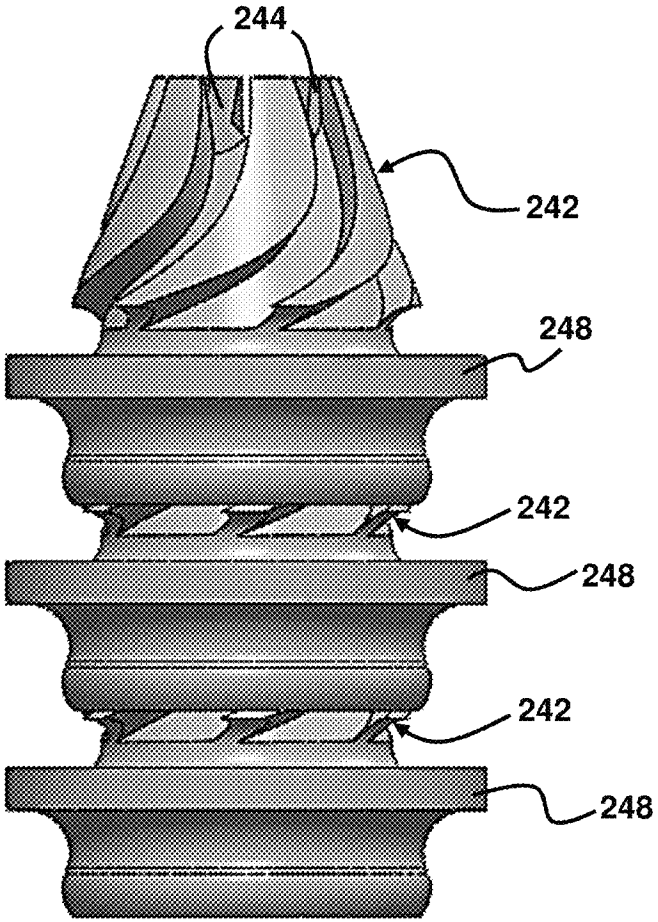
FIG. 24B illustrates a side view nested conical sections with channels, according to an embodiment herein.
Figure 24A:
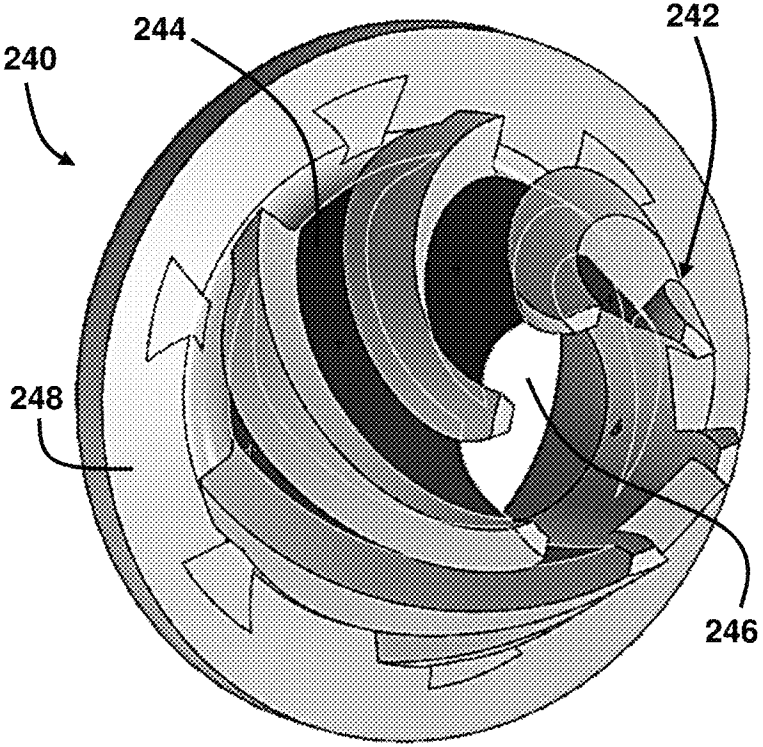
FIG. 24A illustrates a top perspective view nested conical sections with channels, according to an embodiment herein.

FIGS. 24A and 24B, with reference to FIGS. 1 through 23, illustrates an assembly 240 comprising nested cones 242 with channels 244. The nested cones 242 with channels 244 form a linear assembly 240 when nested or stacked together to quiet gasses as they pass through the center-line ports 246. When nested, the geometries of the cones 242 form circulation regions at the perimeter where the flow exiting the channels 244 may circulate. Each void is created between two adjacent flanges 248 when multiple nested assemblies 240 are inserted into a cylinder (e.g., volume chamber 66, for example). In order for the flow to exit these circulation voids, ports may be added to the outer cylinder to correspond to these circulation voids. These ports may redirect the flow into other regions for stimulating vortices or sound abatement through out-of-phase pulsation averaging.

In accordance with the embodiments herein, repeated structures within pipes (e.g., pipes 38, 68 or regions/chambers 32, 54, 66, for example) may be configured to create intermittent vortex sections in the muffler 10, 10*a*, 10*b*. Variations of the configurations described previously may be incorporated into a long pipe, such as the straight exhaust or vent pipes on longer vehicles like school buses, box trucks and limousines. Varying degrees of obstructions to flow may be configured for any pipe diameter. Some configurations will maintain an unobstructed center-line flow and use peripheral structures as low-profile expansion regions and to create vorticity from the outer portions of flow that interact with these structures. Once the vorticity is initiated at the outer periphery of the pipe, the exhaust in the inner range will be entrained and forced to circulate as well. A circular baffle with a hole in the center may be used to create an expansion region and prolong circulation in that section. By creating sequential instances of these flow simulators within the long pipe, the aggregate effects of repeated vorticity segments and expansion regions will further quiet the exhaust flow before exiting to the atmosphere.

Concentric cones centered along the longitudinal axis may force gasses radially outward toward the containment pipe's wall, where vanes, impellers, louvers or angled deflectors may create vorticity downstream of each cone. These flow redirection methods may be integral to the cones or separate. Moreover, spiral vanes in front of an obstructive baffle or cone section, which only blocks the center portion of the pipe's cross-sectional area, may also force gases outward and introduce circulation in the muffler 10, 10*a*, 10*b*.

Additionally, spiral sections may be either inserted into pipes or the pipes may be created by welding multiple spiral sections together with deflectors or baffles between each section. Each spiral section may include a mechanism to allow flow to enter the gap between the overlapping portion of the spirals, and a component to prevent flow from continuing through the overlapping gap portion of the spiral; thereby forcing the gasses to exit tangentially into the interior of the spiral chamber to create circulation. This may be in the form of an input circular cover plate with a hole or slot positioned to feed the gap portion of the spiral, and an output cover plate that has a hole in the center for vortex exit. Flow deflectors or baffles may deflect the gasses into the spiral gap.

Figure 25:
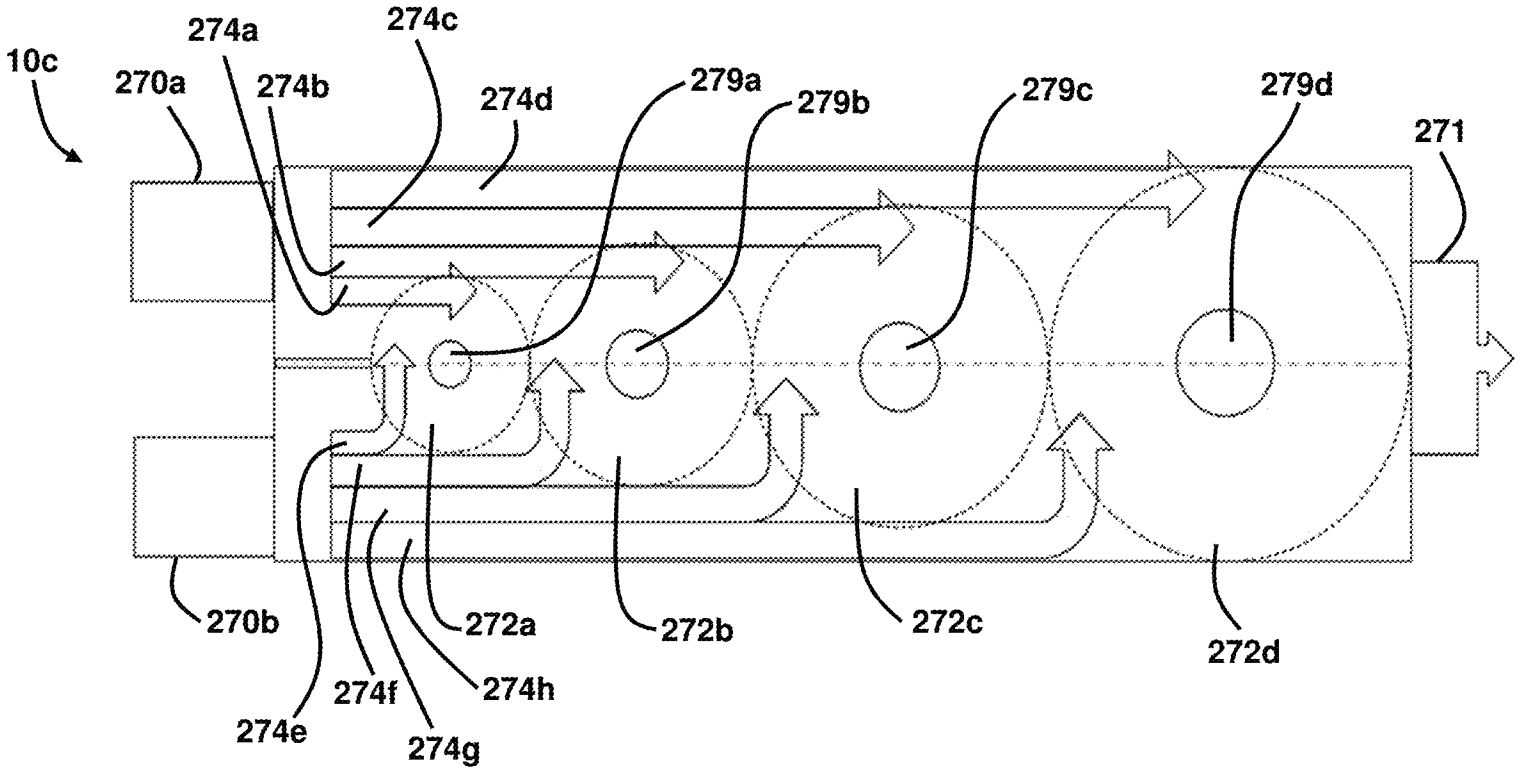
FIG. 25 illustrates twin-pipe inputs into multiple vortex diodes, according to an embodiment herein.

FIG. 25, with reference to FIGS. 1 through 24B, illustrates a muffler 10*c* comprising twin-pipe inputs 270*a*, 270*b* feeding into multiple vortex diodes 272*a*-272*d* before exiting through a common egress pipe 271. Some ATVs or engines have twin pipes coming off the engine manifold, and pipes 270*a*, 270*b* are representative of such an embodiment. The pressure pulsations in the two pipes 270*a*, 270*b* are out of phase from each other, as they come from different, but synchronized, portions of the engine. The two pipes 270*a*, 270*b* may be summed together before entering a muffler 10*c*. The two input pipes 270*a*, 270*b* provided in FIG. 25 are individually to feed four vortex diodes 272*a*-272*d* from differing directions and with potentially different input impedances. Each input pipe 270*a*, 270*b* is respectively split into four individual channels 274*a*-274*h* and each one feeds a vortex diode 272*a*-272*d* of differing sizes. The upper half of the muffler 10*c* represented in FIG. 25 has straight channels 274*a*-274*d* leading tangentially into each vortex diode 272*a*-272*d*, while the lower half of the muffler 10*c* has bent channels 274*e*-274*h* that change the input impedance prior to entering the vortex diodes 272*a*-272*d* tangentially from a different direction. Each vortex diode 272*a*-272*d* has two inputs of either similar or differing diameters and flow rates. The two inputs are shown entering ninety degrees apart from each other, tangentially along the perimeter, in the clockwise direction. Both will reinforce circulation in the clockwise direction. The number of inputs and the angle of separation may be altered to achieve the desired noise reduction effects. As the pulsations travel around the perimeter due to the vortex flow, the out of phase pulsations expand, diffract, entrain and add together to reduce the highest pressure pulsations and create more of a broadband spectrum. Each central egress port 279*a*-279*d* of the vortex diodes 272*a*-272*d*, respectively, may be combined within egress pipe 271 or an expansion volume (not shown) in fluid communication with egress pipe 271.

Figure 26:
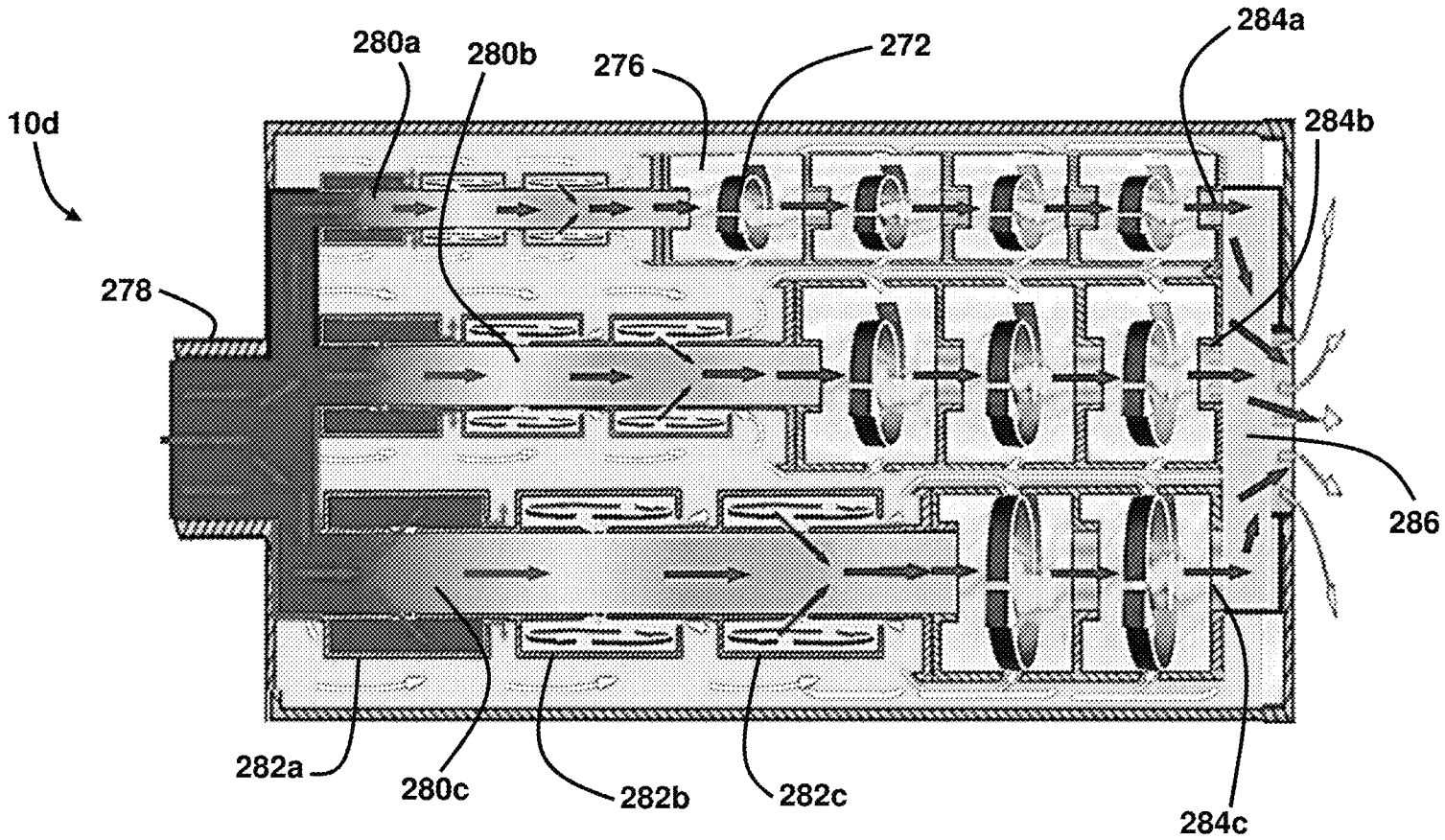
FIG. 26 illustrates combined multidimensional vortex diodes and circulation regions within a muffler, according to an embodiment herein.

FIG. 26, with reference to FIGS. 1 through 25, illustrates combined multidimensional vortex diodes 272 and circulation regions 276 within a muffler 10*d*. A muffler may be created with many combinations of all features described previously with respect to the multiple embodiments herein. In the example of FIG. 26, the input gas from input pipe 278 is separated into three different size supply pipes 280*a*-280*c*, with each supply pipe 280*a*-280*c* feeding three pairs of vortex diodes 282*a*-282*c* before entering into multiple circulation regions 276. These different size diodes 282*a*-282*c* are oriented to allow high-pressure pulsations to easily enter the surrounding pressure containment chambers. Due to the nature of the ability of the vortex diodes 282*a*-282*c* to have higher flow resistance in the reverse direct, these vortex diodes 282*a*-282*c* limit or inhibit the pressure pulsations within the containment chambers from reentering the three supply pipes 280*a*-280*c*.

The higher pressures within the containment regions may tangentially feed and help sustain circulation within the different sized circulation chambers; four small, three medium, and two large circulation regions 276 shown in the example of FIG. 26. Each circulation region 276 may also have vanes or louvers to initiate circulation at the entrance to each chamber. Finally, the output 284*a*-284*c* of the three flow paths may be summed in a terminal chamber 286 before final egress out of the muffler 10*d*.

Figure 27:
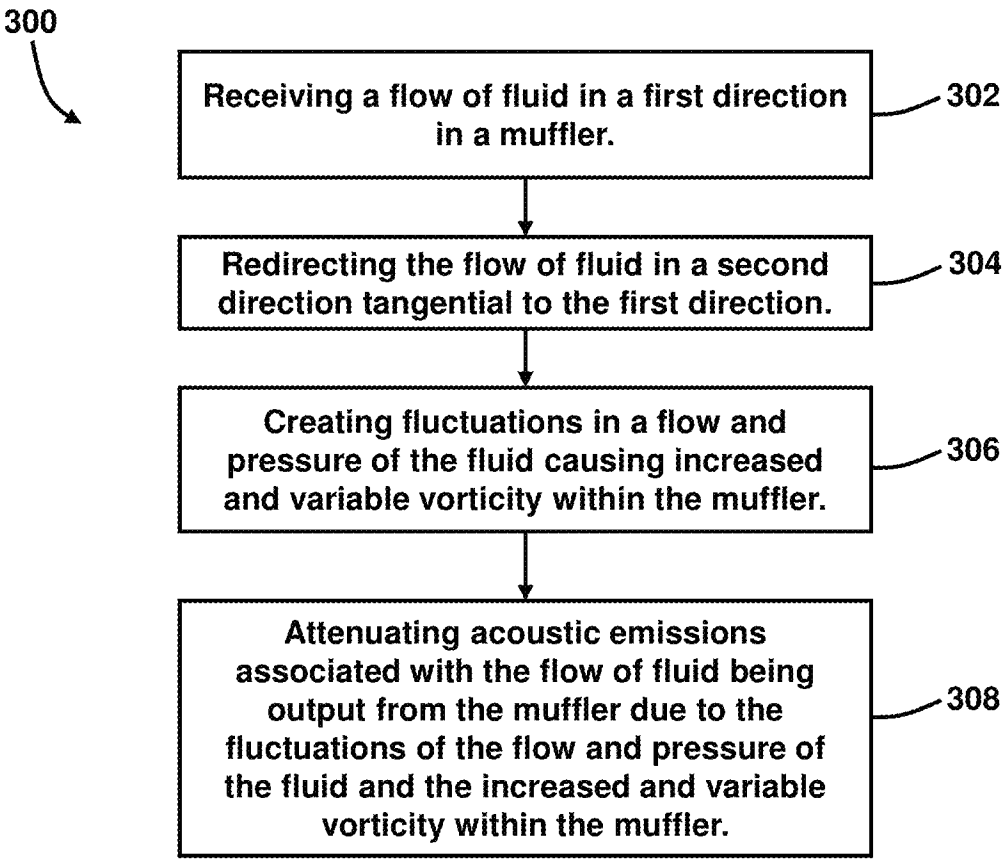
FIG. 27 is a flow diagram illustrating a method of abating noise, according to an embodiment herein.

FIG. 27, with reference to FIGS. 1 through 26, is a flow diagram illustrating a method 300 of abating noise, wherein the method 300 comprises receiving (302) a flow of fluid in a first direction in a muffler 10-10*d*; redirecting (304) the flow of fluid in a second direction tangential to the first direction; creating (306) fluctuations in a flow and pressure of the fluid causing increased and variable vorticity within the muffler 10-10*d*; and attenuating (308) acoustic emissions associated with the flow of fluid being output from the muffler 10-10*d* due to the fluctuations of the flow and pressure of the fluid and the increased and variable vorticity within the muffler 10-10*d*. The method may further comprise radially expanding the flow of fluid within the muffler 10-10*d*, creating a vortex circulation of the flow of fluid within the muffler 10-10*d*, and modifying any of the vorticity and the acoustic emissions in the muffler 10-10*d*.

In accordance with the embodiments herein, a vorticity muffler uses vortex diodes and vorticity-based features to attenuate the noises emanating from an engine's exhaust. By creating geometries that force the exhausting gasses into circulation and vorticity, the pressure and flow pulsations from engine exhaust may be reduced. Mechanical deflectors and passageways in the form of spiral vanes, fins, channels, impellers and louvers are used within the muffler 10*d* to force gasses to be tangentially injected on the inside of cylindrical walls or pipes to create a vortex within. Numerous adjacent vortices may interact with each other to blend and average out pressure perturbations. Exploiting centripetal acceleration and increased radial pressures at the outer boundaries helps maintain the highest pressures outward and away from an exit port typically located at the center of rotation. Numerous mechanisms are described to create these vortex flows of varying scales or dimensions. When combined in series or parallel, with differing lengths, radii of curvature and volumes, the pressure and flow perturbations from an engine may be reduced by averaging flows, common mode rejection, out of phase cancellation, and spreading the spectrum of noises within the muffler. As the engine's RPM and loading are varied, the flow and pressure perturbations feeding these vorticity chambers also vary. Fluctuations in pressure and flow through a jet or orifice will create corresponding fluctuations in velocity entering the circulating flow, which in turn will modify the extent of circulation within the entire cylindrical chamber. As the flow has opportunities to circulate multiple revolutions within the chamber, a blending, mixing and smoothing of the perturbations will occur. Residual circulation from one muffler section may help initiate or sustain circulation in the next chamber, especially when reinforced with additional tangentially stimulating flow. Configurations will scale for diverse engine sizes and flow rates, and may be utilized, for example, on vehicles, generators, engines, lawn/garden equipment, and recreational hardware.

The foregoing description of the specific embodiments will so fully reveal the general nature of the embodiments herein that others may, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It should be appreciated that the various combinations of the features described herein may be adjusted in size and applied either serially, in parallel, or in combinations of serial and parallel configurations. It is to be understood that the phraseology or terminology employed herein is for the purpose of description and not of limitation. Therefore, while the embodiments herein have been described in terms of preferred embodiments, those skilled in the art will recognize that the embodiments herein may be practiced with modification within the spirit and scope of the appended claims.

What is claimed is:

1. A noise abatement system comprising:

at least one fluid circulation chamber to receive at least one flow of fluid;

at least one vorticity-inducing component adjacent to the at least one fluid circulation chamber, the at least one vorticity-inducing component to redirect the at least one flow of fluid tangentially to an inside perimeter wall of the at least one fluid circulation chamber to create fluctuations in a flow and pressure of the fluid causing increased and variable vorticity within the at least one fluid circulation chamber;

at least one vorticity-interaction region in communication with the at least one vorticity-inducing component to attenuate acoustics caused by the at least one flow of fluid wherein the at least one fluid circulation chamber comprises a cylindrical chamber, wherein the at least one vorticity-inducing component is configured to create a vortex diode comprising hysteretic flow pressure resistance of the fluid, wherein the at least one vorticity-inducing component comprises at least one radial expansion component to radially expand the at least one flow of fluid, and wherein the at least one radial expansion component is configured to receive the at least one flow of fluid in an axial direction relative to the fluid circulation chamber and disperse the at least one flow of fluid in a tangential direction relative to the circulation chamber, wherein the at least one fluid circulation chamber that disperses the at least one flow of fluid in the tangential direction creates a vortex circulation of the at least one flow of fluid, wherein the at least one radial expansion component comprises a plurality of radial expansion components arranged in a nested configuration, further comprising at least one input pipe operatively connected to the at least one fluid circulation chamber, wherein the at least one input pipe is positioned tangential to the at least one fluid circulation chamber, and wherein the at least one input pipe comprises a multi-shaped configuration that transitions from a substantially curved configuration to a substantially quadrilateral configuration.

2. The system of claim 1, comprising a muffler containing the at least one fluid circulation chamber, wherein each fluid circulation chamber is configured to provide a different vortex flow of the at least one fluid from other fluid circulation chambers.

3. A method of abating noise, the method comprising:

receiving a flow of fluid in a first direction in a muffler;

redirecting the flow of fluid in a second direction tangential to the first direction;

creating fluctuations in a flow and pressure of the fluid causing increased and variable vorticity within the muffler;

attenuating acoustic emissions associated with the flow of fluid being output from the muffler due to the fluctuations of the flow and pressure of the fluid and the increased and variable vorticity within the muffler, further comprising radially expanding the flow of fluid within the muffler, further comprising creating a vortex circulation of the flow of fluid within the muffler and, further comprising modifying any of the vorticity and the acoustic emissions in the muffler.

4. The method of claim 3, comprising modifying any of the vorticity and the acoustic emissions in the muffler.

* * * * *